US007986295B2

(12) United States Patent
Yamamoto

(10) Patent No.: US 7,986,295 B2
(45) Date of Patent: Jul. 26, 2011

(54) IMAGE DISPLAY CONTROL DEVICE

(75) Inventor: Takekuni Yamamoto, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 891 days.

(21) Appl. No.: 11/980,652

(22) Filed: Oct. 31, 2007

(65) Prior Publication Data

US 2008/0129679 A1 Jun. 5, 2008

(30) Foreign Application Priority Data

Nov. 10, 2006 (JP) ..... 2006-304669
Oct. 19, 2007 (JP) ..... 2007-272740

(51) Int. Cl.
*G09G 3/36* (2006.01)

(52) U.S. Cl. ..... 345/102; 345/89; 345/204; 345/207; 345/690

(58) Field of Classification Search ..... 345/87–102, 345/204–215, 690
See application file for complete search history.

(56) References Cited

U.S. PATENT DOCUMENTS

| | | | | |
|---|---|---|---|---|
| 7,133,070 | B2 * | 11/2006 | Wheeler et al. | 348/223.1 |
| 7,202,850 | B2 | 4/2007 | Kitagawa | |
| 7,421,141 | B2 | 9/2008 | Kurumisawa et al. | |
| 7,728,845 | B2 * | 6/2010 | Holub | 345/589 |
| 7,737,933 | B2 * | 6/2010 | Yamano et al. | 345/94 |
| 2003/0095197 | A1 * | 5/2003 | Wheeler et al. | 348/241 |
| 2004/0066363 | A1 * | 4/2004 | Yamano et al. | 345/98 |
| 2004/0213457 | A1 | 10/2004 | Mori | |
| 2005/0141777 | A1 | 6/2005 | Kuwata | |
| 2005/0184952 | A1 | 8/2005 | Konno et al. | |
| 2005/0286061 | A1 * | 12/2005 | Kurumisawa | 358/1.9 |
| 2006/0280360 | A1 * | 12/2006 | Holub | 382/162 |

FOREIGN PATENT DOCUMENTS

| | | |
|---|---|---|
| JP | A 11-065531 | 3/1999 |
| JP | A 2004-191950 | 7/2004 |
| JP | A 2004-200904 | 7/2004 |
| JP | A 2004-310671 | 11/2004 |
| JP | A 2005-108194 | 4/2005 |
| JP | A 2005-258403 | 9/2005 |
| KR | 10-2006-0050883 A | 5/2006 |

OTHER PUBLICATIONS

U.S. Appl. No. 11/980,614, filed Oct. 31, 2007, in the name of Takekuni Yamamoto et al.
U.S. Appl. No. 11/980,685, filed Oct. 31, 2007, in the name of Takekuni Yamamoto.

* cited by examiner

*Primary Examiner* — Vijay Shankar
(74) *Attorney, Agent, or Firm* — Oliff & Berridge, PLC

(57) ABSTRACT

An image display control device includes a statistical information acquisition section that quickly acquires statistical information of a video image. In the statistical information acquisition section, an image signal of a video image is parallelly input to each of a plurality of statistical value units (EX0 to EX255) having an identical configuration to simultaneously update a luminance count value. A luminance maximum value/minimum value detector and a standard deviation calculation section respectively calculate a luminance maximum value/minimum value and a standard deviation value at high speed based on the count values. Statistical information relating to chroma is also acquired by providing a luminance total value unit (ES(Y)), a blue chroma total value unit (ES(Cb)), and a red chroma total value unit (ES (Cr)) having an identical configuration. The supply of an operation clock signal to each circuit is suspended using a gate circuit, if necessary.

6 Claims, 15 Drawing Sheets

: REDUCTION IN POWER CONSUMPTION IS SMALL

: REDUCTION IN POWER CONSUMPTION IS NORMAL

: REDUCTION IN POWER CONSUMPTION IS LARGE

Δ Gy (Gy' -Gy): INCREASE IN AMOUNT OF IMAGE CORRECTION ACCOMPANYING LUMINANCE ADJUSTMENT

FIG. 6A
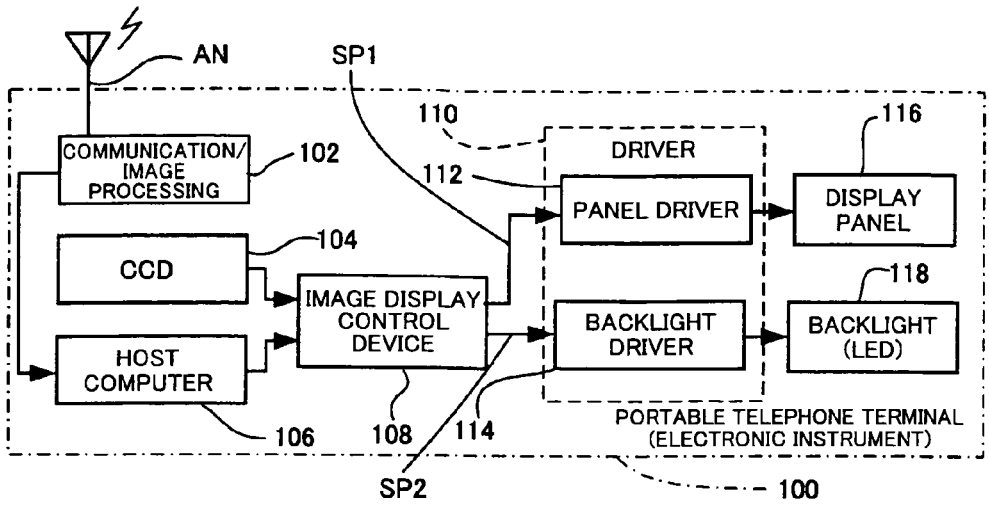
FIG. 6B
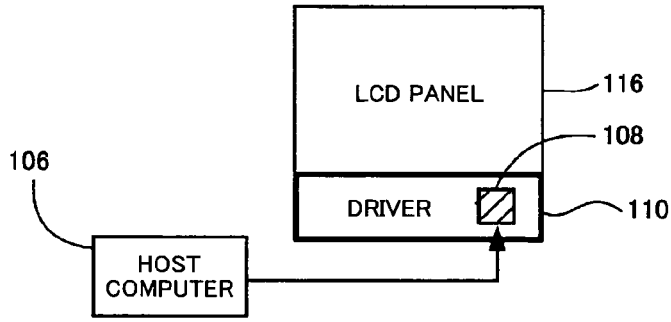
FIG. 6C
FIG. 6D
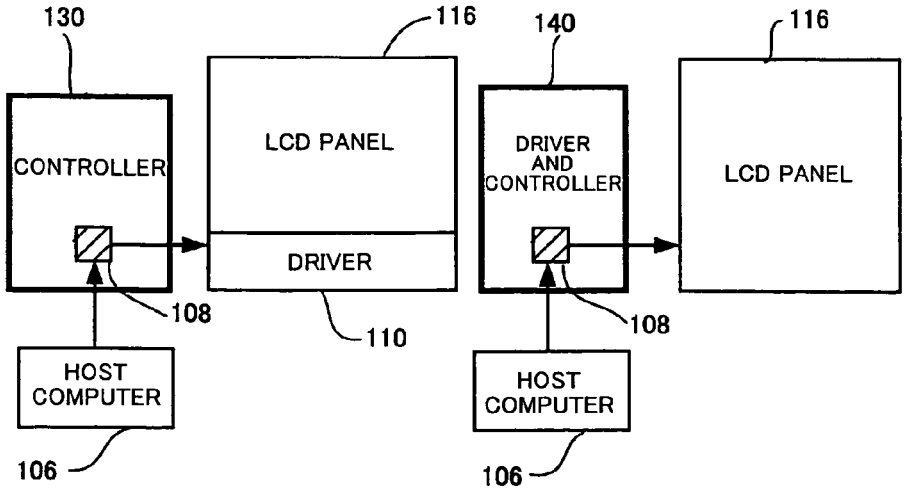

IMAGE DISPLAY CONTROL DEVICE

Japanese Patent Application No. 2006-304669 filed on Nov. 10, 2006 and Japanese Patent Application No. 2007-272740 filed on Oct. 19, 2007, are hereby incorporated by reference in their entirety.

BACKGROUND OF THE INVENTION

The present invention relates to an image display control device and the like. More particularly, the invention relates to an image display control device which acquires statistical information of an input image and adaptively corrects the image based on the acquired statistical information, and the like.

JP-A-2004-200904 and JP-A-2005-108194 disclose technology which corrects a still image based on a statistical value of the still image.

JP-A-11-65531 discloses technology which reduces the quantity of light emitted from a backlight aimed at reducing power consumption, and adjusts image data to increase the transmissivity of a liquid crystal display screen as much as possible.

JP-A-2004-310671 discloses an image correction device which uses a look-up table (LUT) in order to correct a luminance signal of a display image.

In order to adaptively correct a video image based on a statistical value, it is necessary to efficiently and quickly acquire the statistical value of the video image.

In particular, in order to simultaneously perform a reduction in luminance of lighting (e.g., backlight) and adaptive video image correction aimed at preventing deterioration in image quality, it is necessary to perform a large number of calculations based on various acquired statistical values. Therefore, it is indispensable to efficiently and quickly acquire various statistical values used for calculations.

For example, in order to appropriately correct a video image, it may be necessary to acquire the statistical value relating to the chroma (color difference) of the input video image in real time in addition to the statistical value relating to the luminance. It may also be necessary to acquire the average value of the luminance, the average value of the chroma (color difference), and the like in real time in addition to the maximum value, the minimum value, and the standard deviation value of the luminance. In such a case, the statistical value acquisition operation and the circuit configuration of a statistical information acquisition section (histogram creation section) become more and more complicated.

Calculations performed when simultaneously performing a reduction in luminance and image correction may be simplified by utilizing a look-up table (LUT) which stores calculation results. However, memory access takes time. Therefore, a method using an LUT is not suitable when a real-time capability is required, such as when reproducing a streaming image distributed by one-segment broadcasting (digital broadcasting for portable telephone terminals) using a portable telephone terminal.

A high-speed capability (real-time capability) can be ensured by causing a plurality of pieces of dedicated hardware to perform specific calculations in parallel. However, the occupied area and the power consumption of the circuit are inevitably increased.

As described above, in order to perform adaptive real-time video image correction (in particular, simultaneously perform a reduction in lighting luminance and image correction which compensates for deterioration in image quality due to a reduction in luminance), a real-time capability is required for acquisition of the statistical information and calculations using the statistical information. Moreover, suppression of an increase in circuit scale and a reduction in power consumption are also required. Related-art technologies cannot deal with such requirements.

SUMMARY

According to one aspect of the invention, there is provided an image display control device that corrects an image signal based on statistical information, the image display control device comprising:

a statistical information acquisition section that acquires the statistical information of the image signal in a frame unit;

a calculator that generates a correction coefficient used to correct the image signal using the statistical information of a preceding frame output from the statistical information acquisition section; and an image correction section that corrects the image signal using the correction coefficient, the statistical information acquisition section including:

a plurality of statistical units, each of the plurality of statistical units including a comparator that compares a luminance of the image signal with a reference luminance and outputs a comparison result;

a statistical value buffer that updates a count value based on the comparison result; and a statistical value calculation section that calculates a specific statistical value based on the count value of the statistical value buffer that is output from each of the plurality of statistical units, the reference luminance of each of the plurality of statistical units being set to be a different value, and the image signal being parallelly input to each of the plurality of statistical units.

According to another aspect of the invention, there is provided a driver device of an electro-optical device, the driver device including the above image display control device.

According to a further aspect of the invention, there is provided a control device of an electro-optical device, the control device including the above image display control device.

According to still another aspect of the invention, there is provided a drive control device of an electro-optical device, the drive control device including the above image display control device.

According to a still further aspect of the invention, there is provided an electronic instrument including the above image display control device.

BRIEF DESCRIPTION OF THE SEVERAL VIEWS OF THE DRAWING

FIGS. 6A to 6D are block diagrams illustrative of mounting of an image display device according to the invention.

DETAILED DESCRIPTION OF THE EMBODIMENT

Figure 1A:
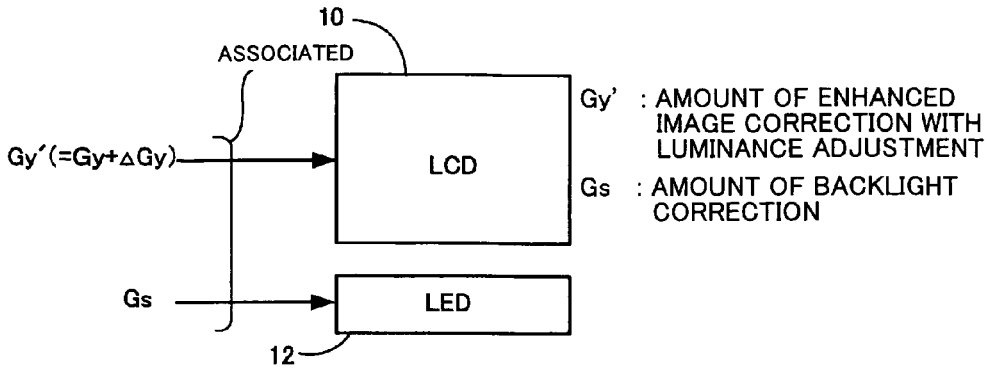
FIGS. 1A to 1C are views illustrative of adaptive luminance adjustment corresponding to a display image and image correction employed in an image display control device (image display control LSI) according to the invention.

Aspects of the invention may enable various types of statistical information of a video image to be quickly and efficiently acquired while preventing complication of a circuit configuration, and may enable calculations using the statistical information to be quickly and efficiently performed. As a result, adaptive reduction in lighting luminance and highly accurate image correction which compensates for deterioration in image quality due to a reduction in luminance may be implemented at the same time while reducing power consumption and suppressing an increase in circuit scale.

(1) According to one embodiment of the invention, there is provided an image display control device that corrects an image signal based on statistical information, the image display control device comprising:

a statistical information acquisition section that acquires the statistical information of the image signal in a frame unit;

a calculator that generates a correction coefficient used to correct the image signal using the statistical information of a preceding frame output from the statistical information acquisition section; and an image correction section that corrects the image signal using the correction coefficient, the statistical information acquisition section including:

a plurality of statistical units, each of the plurality of statistical units including a comparator that compares a luminance of the image signal with a reference luminance and outputs a comparison result;

a statistical value buffer that updates a count value based on the comparison result; and a statistical value calculation section that calculates a specific statistical value based on the count value of the statistical value buffer that is output from each of the plurality of statistical units, the reference luminance of each of the plurality of statistical units being set to be a different value, and the image signal being parallelly input to each of the plurality of statistical units.

The image signal is parallelly input to each statistical unit configured to compare the luminance of the image signal with the reference luminance and update the count value, and each statistical unit simultaneously and parallelly updates the luminance count value, whereby the luminance count value is acquired at an extremely high speed. The reference luminance of each statistical unit is set to be a different value. The statistical value calculation section acquires the luminance count value that is parallelly output from each statistical unit, and quickly calculates the statistical value necessary for image correction. This makes it possible to acquire the statistical value of a video image (e.g., streaming image) in real time.

(2) In the image display control device, the statistical value calculation section included in the statistical information acquisition section may include:

a luminance maximum value/minimum value detection section that detects a luminance maximum value and a luminance minimum value of the image signal; and a standard deviation calculation section that calculates a standard deviation value, the luminance maximum value, the luminance minimum value, and the standard deviation value may be supplied to the calculator.

Since the luminance distribution of the image of one frame can be estimated based on the maximum value, the minimum value, and the standard deviation value, the statistical value calculation section calculates these three values.

(3) In the image display control device, the statistical information acquisition section may further acquire statistical information relating to a blue chroma and statistical information relating to a red chroma included in the image signal.

According to the above configuration, the statistical information relating to the blue chroma (Cb) and the red chroma (Cr) can be acquired taking into account the case where the statistical information relating to the chroma (color difference) is required for image correction in addition to the statistical information relating to the luminance.

(4) In the image display control device, the statistical information acquisition section may have a configuration that acquires the statistical information relating to the blue chroma and the statistical information relating to the red chroma, the statistical information acquisition section including:

a luminance total value unit that includes an adder that accumulates a luminance of each pixel, and a luminance total value buffer that stores the accumulated value as a luminance total value;

a blue chroma total value unit that includes an adder that accumulates a blue chroma of each pixel, and a blue chroma total value buffer that stores the accumulated value as a blue chroma total value;

a red chroma total value unit that includes an adder that accumulates a red chroma of each pixel, and a red chroma total value buffer that stores the accumulated value as a red chroma total value; and an average calculation section that calculates a luminance average value, a blue chroma average value, and a red chroma average value based on the luminance total value, the blue chroma total value, and the red chroma total value that have been calculated.

The above configuration specifies a configuration which acquires the luminance average value, the red chroma (Cr) average value, and the blue chroma (Cb) average value of the video image of one frame. Specifically, total value units respectively corresponding to the luminance, the red chroma, and the blue chroma are provided, and each total value unit basically includes an adder and a register. The configuration of each total value unit is simple and is identical with the configuration of the statistical value unit which acquires the statistical value relating to the luminance. Therefore, these units can be arranged at a high density. The average calculation section quickly calculates each average value based on the total values of the luminance, the red chroma, and the blue chroma that are parallelly output from the total value units.

(5) In the image display control device, a statistical information acquisition operation of the statistical information acquisition section may be suspended when it is unnecessary to acquire the statistical information.

In the statistical information acquisition section, each unit is operated in parallel so that the statistical value can be acquired at an extremely high speed. Therefore, power consumption increases to some extent. However, power consumption can be reduced by suspending the statistical information acquisition operations at the same time when the statistical information is unnecessary (e.g., when a pause button has been pressed so that reproduction of the video image is suspended).

(6) In the image display control device, a count operation of the statistical value buffer included in each of the plurality of statistical units may be suspended when it is unnecessary to acquire the statistical information.

The above configuration aims at reducing power consumption by suspending the luminance count operation of the statistical value buffer.

(7) In the image display control device, the image display control device may include a gate circuit that controls supply/non-supply of an operation clock signal to each of the statistical value buffers, output/non-output of the operation clock signal from the gate circuit may be switched using a first enable signal.

The above configuration specifies that clock gating utilizing the first enable signal and the gate circuit is performed in order to suspend the luminance count operation of the statistical value buffer. Since the supply/non-supply of the operation clock signal can be easily controlled, the circuit configuration does not become complicated and is easily implemented.

(8) In the image display control device, a count operation of the statistical value buffer included in each of the plurality of statistical units and a count operation of each of the luminance total value buffer, the blue chroma total value buffer, and the red chroma total value buffer may be suspended when it is unnecessary to acquire the statistical information.

According to the above configuration, power consumption is effectively reduced by suspending the count operations of the luminance total value buffer, the blue chroma total value buffer, and the red chroma total value buffer in addition to the statistical value buffer that counts the luminance. Since each buffer has an identical configuration and performs the count operation in synchronization with the clock signal, the count operation can be easily suspended by suspending the supply of the common operation clock signal.

(9) In the image display control device, the image display control device may include a gate circuit that supplies the operation clock signal to each of the luminance total value buffer, the blue chroma total value buffer, and the red chroma total value buffer, output/non-output of the operation clock signal from the gate circuit may be switched using a second enable signal.

According to the above configuration, clock gating utilizing the second enable signal and the gate circuit is performed in order to suspend the count operations of the luminance total value buffer, the blue chroma total value buffer, and the red chroma total value buffer. Since the supply/non-supply of the operation clock signal can be easily controlled, the circuit configuration does not become complicated and is easily implemented.

(10) In the image display control device, the calculator may calculate a luminance of image display lighting after reduction in luminance when luminance adjustment control that adaptively reduces the luminance of the lighting corresponding to the image signal has been performed using the statistical information in the preceding frame, and may generate the correction coefficient used to correct the image signal to compensate for deterioration in image quality accompanying the reduction in the luminance of the lighting.

According to the above configuration, the calculator also calculates the lighting luminance after adaptively reducing the luminance using the calculated statistical value, and calculates the correction coefficient necessary for image correction which compensates for deterioration in image quality due to a reduction in luminance.

(11) In the image display control device, the image display control device may further include:

a code storage section that stores a plurality of codes, the plurality of codes specifying an operation procedure of the calculator;

a sequence instruction section that controls an order of output of the plurality of codes from the code storage section; and a decoder that decodes the plurality of codes output from the code storage section and generates at least one of an instruction and data supplied to the calculator.

According to the above configuration, adaptive reduction in lighting luminance and image correction are implemented by real-time calculations of a common calculator. The image correction coefficient and the lighting luminance after reduction in luminance are calculated in real time by the calculations of the common calculator, and image correction using the calculated correction coefficient is performed. The calculations of the common calculator are controlled by microcodes which specify a signal processing procedure. Real-time calculations can be implemented without parallelly providing the same type of hardware by utilizing the common calculator, whereby high-speed luminance adjustment control and image correction can be implemented using a minimum number of circuits and with minimum power consumption.

(12) In the image display control device, the calculator may include a first multiplexer and a second multiplexer, an arithmetic logic unit, and a distributor that distributes calculation results of the arithmetic logic unit; and the decoder may supply a coefficient to the first multiplexer and the second multiplexer, may supply an operation instruction to the arithmetic logic unit, and may supply distribution information to the distributor.

The above configuration gives an example of a specific configuration of the common calculator, and also specifies the instruction or data supplied to each element. According to this aspect, the common calculator includes a plurality of multiplexers, an arithmetic logic unit (ALU), and a distributor. A coefficient used for calculations is supplied to the multiplexers, an instruction (operation code) is supplied to the ALU, and destination information is supplied to the distributor.

(13) In the image display control device, the calculator may further include:

a plurality of output destination registers; and a feedback path, signals stored in the plurality of output destination registers being at least partially fed back to an input side of the calculator through the feedback path.

The above configuration specifies that the common calculator includes the feedback path through which the calculation results are fed back to the input side. This makes it possible to perform a process in which the lighting luminance after reduction in luminance is calculated by a first calculation process, the calculation results are fed back to the input side, and the image correction coefficient is calculated based on the calculated lighting luminance, for example. An infinite impulse response (IIR) filtering process can also be performed by providing the feedback path in the common calculator.

(14) According to another embodiment of the invention, there is provided a driver device of an electro-optical device, the driver device including one of the above image display control devices.

The image display control device (image display control LSI) according to the embodiment of the invention is mounted on a driver device (driver) of an electro-optical device (including liquid crystal display device). The image display control device (image display control LSI) according to the invention has a real-time capability of processing a video image such as a streaming image and allows a reduction in power consumption and size. Therefore, the added value of the driver device (driver) is increased.

(15) According to a further embodiment of the invention, there is provided a control device of an electro-optical device, the control device including one of the above image display control devices.

The image display control device (image display control LSI) according to the embodiment of the invention is mounted on a control device (controller) of an electro-optical device (including liquid crystal display device). The image display control device (image display control LSI) according to the invention has a real-time capability of processing a video image such as a streaming image and allows a reduction in power consumption and size. Therefore, the added value of the control device (controller) is increased.

(16) According to still another embodiment of the invention, there is provided a drive control device of an electro-optical device, the drive control device including one of the above image display control devices.

The image display control device (image display control LSI) according to the embodiment of the invention is mounted on a drive control device (device in which a driver and a controller are integrated) of an electro-optical device (including liquid crystal display device). The image display control device (image display control LSI) according to the invention has a real-time capability of processing a video image such as a streaming image and allows a reduction in power consumption and size. Therefore, the added value of the drive control device (device in which a driver and a controller are integrated) is increased.

(17) According to a still further embodiment of the invention, there is provided an electronic instrument including one of the above image display control devices.

A streaming image distributed by one-segment broadcasting and the like can be displayed with high quality and the life of a battery can be increased by mounting the image display control device (LSI) according to the embodiment of the invention on a portable terminal (including portable telephone terminal, PDA terminal, and portable computer terminal).

The invention is described below in detail. The invention may be widely used as technology of acquiring statistical information of a video image. The invention provides an important technology which ensures real-time capability when adaptively reducing the luminance aimed at reducing power consumption while performing image correction which compensates for deterioration in image quality due to a reduction in luminance. Adaptive luminance adjustment corresponding to a display image and image correction are described below with reference to FIGS. 1 to 10. A specific configuration of a statistical information acquisition section is described thereafter.

First Embodiment

Relationship Between Luminance Adjustment Control and Image Correction

Figure 1B:
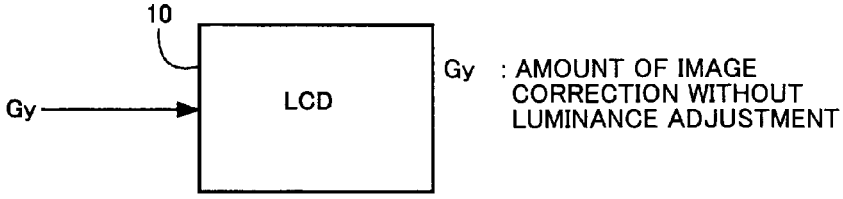
Figure 1C:
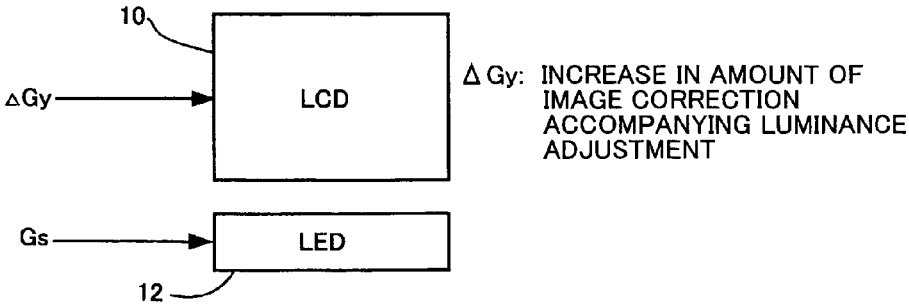

FIGS. 1A to 1C are views illustrative of adaptive luminance adjustment control corresponding to a display image and image correction employed in an image display control device (image display control LSI) according to the invention.

According to one aspect of the invention, as shown in FIG. 1A, adaptive image correction of a liquid crystal panel (LCD) 10 and adaptive correction (adaptive luminance adjustment) of the luminance of lighting (LED; hereinafter referred to as "backlight") 12 are performed at the same time. In FIG. 1A, Gy' indicates the amount of enhanced image correction with luminance adjustment. The amount of image correction Gy' is obtained by adding an increase ΔGy in the amount of image correction accompanying luminance adjustment to the amount of image correction Gy without luminance adjustment. Gs indicates the amount of luminance correction of the backlight 12 accompanying adaptive luminance adjustment.

FIG. 1B shows the amount of image correction Gy without luminance adjustment. Specifically, the amount of image correction Gy is the amount of image correction when the luminance of the backlight 12 is made constant. For example, a portion at a low luminance is corrected to increase the luminance, and a portion at an excessively high luminance is corrected to decrease the luminance.

FIG. 1C shows the increase ΔGy in the amount of image correction accompanying luminance adjustment. Since a dark image is affected to a small extent by a reduction in luminance of the backlight 12 as compared with a bright image, the amount of reduction in luminance of the backlight 12 increases as a rule when displaying a dark image. However, since the luminance of the display image decreases due to a reduction in luminance, image correction is enhanced to compensate for a decrease in luminance. An increase in the amount of image correction accompanying luminance adjustment (Gs) is indicated by ΔGy.

In the invention, as shown in FIG. 1A, the luminance of the backlight 12 is positively reduced in order to reduce power consumption, and the final amount of image correction Gy' is determined by adding an increase (ΔGy) in the amount of image correction accompanying luminance adjustment (Gs)

to the normal amount of image correction (Gy) in order to compensate for deterioration in image quality due to a reduction in luminance.

Amount of Image Correction Accompanying Adaptive Luminance Adjustment

Figure 2:
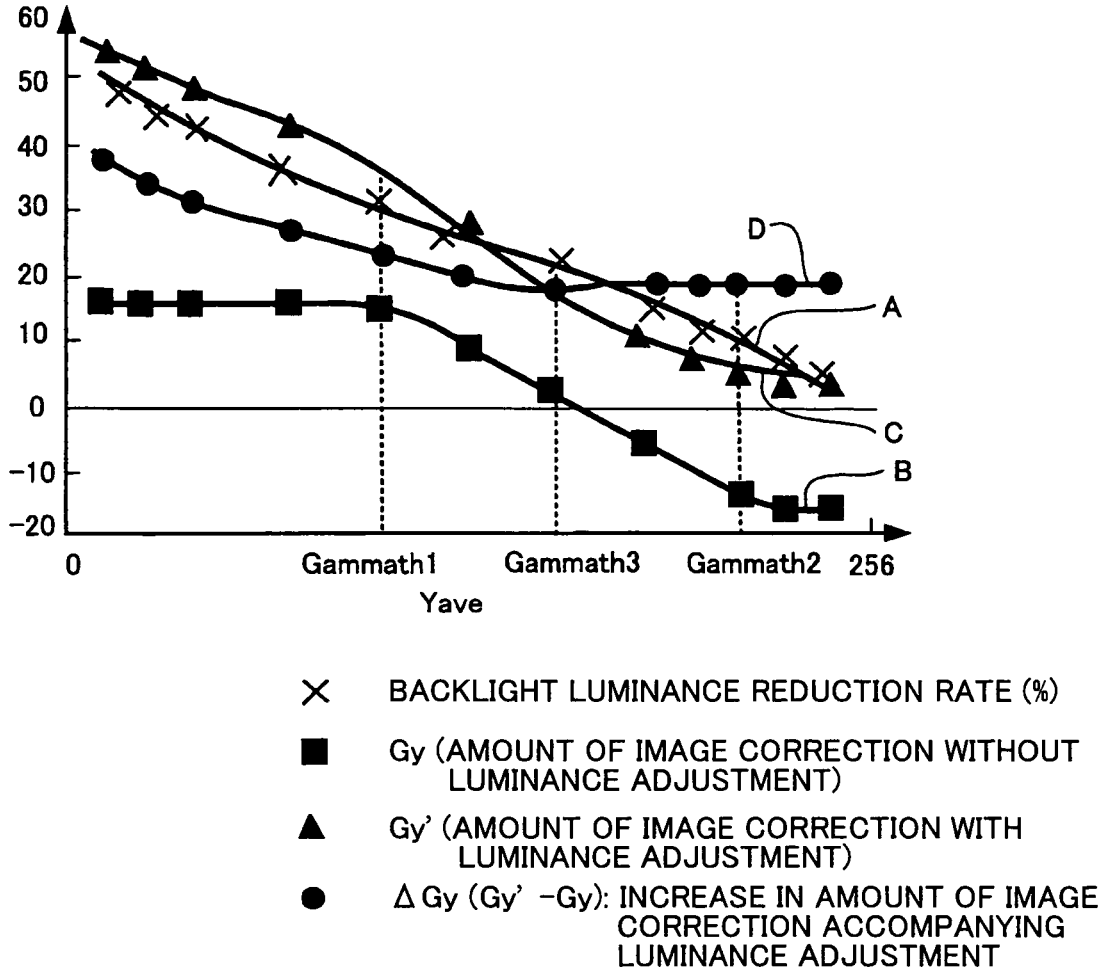
FIG. 2 is a characteristic diagram showing changes in the backlight luminance reduction rate, the amount of image correction (Gy) without luminance adjustment, the amount of image correction (Gy') with luminance adjustment, and an increase (ΔGy) in the amount of image correction accompanying luminance adjustment with respect to the average luminance (Yave) of an image of one frame.

FIG. 2 is a characteristic diagram showing changes in the backlight luminance reduction rate, the amount of image correction (Gy) without luminance adjustment, the amount of image correction (Gy') with luminance adjustment, and an increase (ΔGy) in the amount of image correction accompanying luminance adjustment with respect to the average luminance (Yave) of an image of one frame.

In FIG. 2, a characteristic line A indicates the characteristics of the backlight luminance reduction rate (%), a characteristic line B indicates the characteristics of the amount of image correction (Gy) without luminance adjustment, a characteristic line C indicates the characteristics of the amount of image correction (Gy') with luminance adjustment, and a characteristic line D indicates the characteristics of the increase (ΔGy) in the amount of image correction accompanying luminance adjustment.

The characteristic line A which indicates a change in the backlight luminance reduction rate is analyzed below. As shown in FIG. 2, the backlight luminance reduction rate increases as the average luminance (Yave) decreases, and decreases as the average luminance (Yave) increases. Specifically, since an image with a higher average luminance is affected to a larger extent by a reduction in luminance of the backlight, the luminance of the backlight is reduced to a large extent when the image has a low average luminance as a result of giving priority to a reduction in power consumption, and the luminance of the backlight is reduced to a small extent when the image has a high average luminance as a result of giving priority to suppressing deterioration in image quality.

The characteristic line B which indicates a change in the amount of image correction (Gy) without luminance adjustment is analyzed below. As shown in FIG. 2, an almost constant amount of luminance increase correction is made when the average luminance is equal to or smaller than Gammath1. The amount of increase in luminance decreases as the average luminance increases. When the average luminance exceeds Gammath2, correction is made which decreases the luminance. Specifically, correction which increases the luminance is basically made when the average luminance is low, and correction which decreases the luminance is basically made when the average luminance is too high.

The characteristic line C which indicates a change in the amount of image correction (Gy') with luminance adjustment is analyzed below. As shown in FIG. 2, the amount of image correction increases as the average luminance decreases, and decreases as the average luminance increases. This is because the amount of image correction is determined based on the characteristic line B, and the amount of image correction must be increased when the average luminance is low in order to prevent deterioration in image quality at a low luminance at which the luminance reduction rate is set at a large value.

The characteristic line D which indicates a change in an increase (ΔGy=Gy'−Gy) in the amount of image correction accompanying luminance adjustment is analyzed below. An increase ΔGy in the amount of image correction accompanying luminance adjustment increases as the luminance decreases, and gradually decreases as the luminance increases, as described above. An increase in the amount of image correction gradually increases when the average luminance exceeds about Gammath3. Specifically, since the image quality of an image with a higher luminance may be likely to deteriorate due to a reduction in luminance of the backlight 12, image correction must be enhanced in order to suppress a decrease in luminance of an image with a high average luminance.

Relationship Between Reduction in Power Consumption and ΔGy

Figure 3:
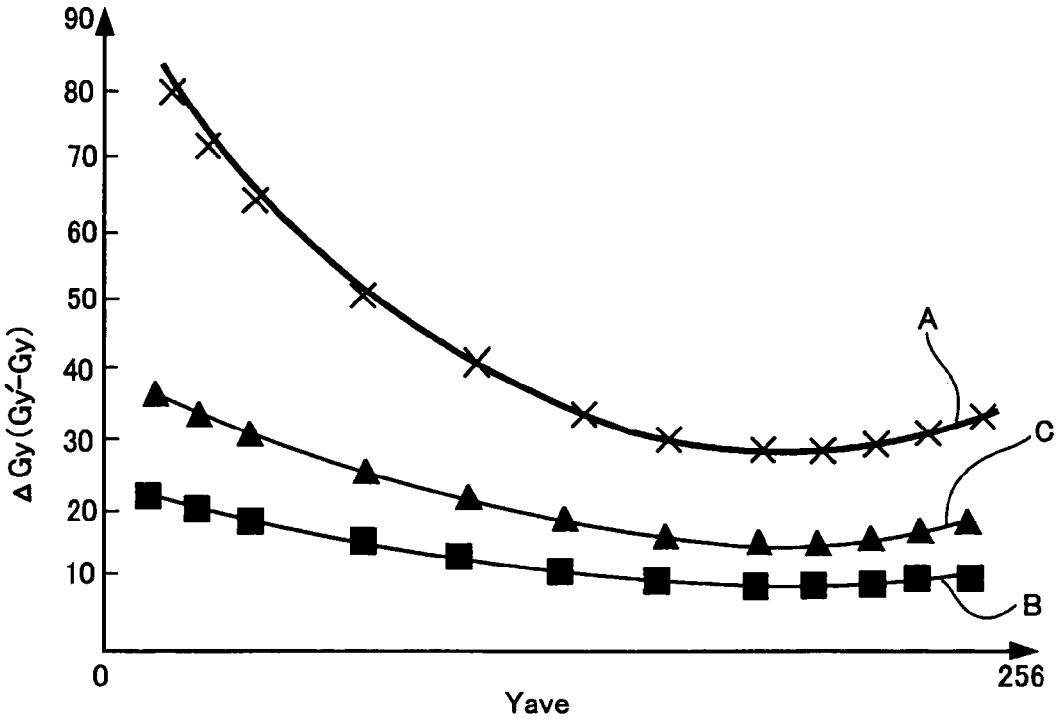
FIG. 3 is a view showing a state in which a characteristic line of an increase (ΔGy=Gy'−Gy) in the amount of image correction accompanying luminance adjustment changes depending on a backlight luminance reduction rate.

FIG. 3 is a view showing a state in which the characteristic line of an increase (ΔGy=Gy'−Gy) in the amount of image correction accompanying luminance adjustment changes depending on the backlight luminance reduction rate. In FIG. 3, a characteristic line A indicates the case where power consumption is reduced to a large extent (backlight luminance reduction rate: 30%), a characteristic line B indicates the case where power consumption is reduced to a small extent (backlight luminance reduction rate: 10%), and a characteristic line C indicates the case where a reduction in power consumption is normal (backlight luminance reduction rate: 20%).

As described above, each characteristic line shows a tendency in which an increase ΔGy in the amount of image correction accompanying luminance adjustment increases as the luminance decreases, gradually decreases as the luminance increases, and again increases gradually as the luminance increases. An increase ΔGy in the amount of image correction accompanying luminance adjustment increases as the backlight luminance reduction rate is increased to reduce power consumption.

Enhancement of Chroma Correction

The chroma of the entire screen decreases due to a reduction in luminance of the backlight. Therefore, chroma correction is performed so that the chroma remains the same before and after luminance adjustment. Chroma correction is basically performed according to the following equation (1). The following equation defines the blue chroma (Cb=Y−B). Note that the same equation applies to the red chroma (Cr=Y−R).

$$Cb[cb]=Fc\times Gc+Cb \quad (1)$$

where, cb indicates a chroma correction input color difference, Cb indicates a chroma correction output color difference, Gc indicates the amount of chroma correction, and Fc indicates a chroma correction coefficient curve.

Figure 4A:
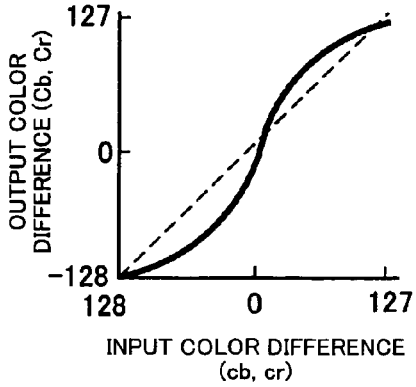
FIGS. 4A to 4C are views illustrative of chroma correction.
Figure 4B:
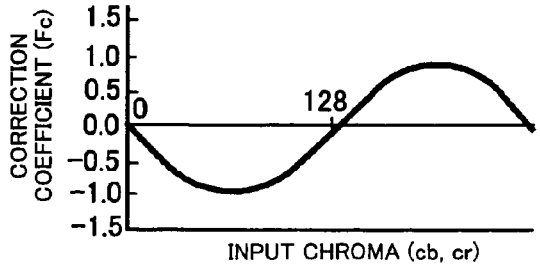
Figure 4C:
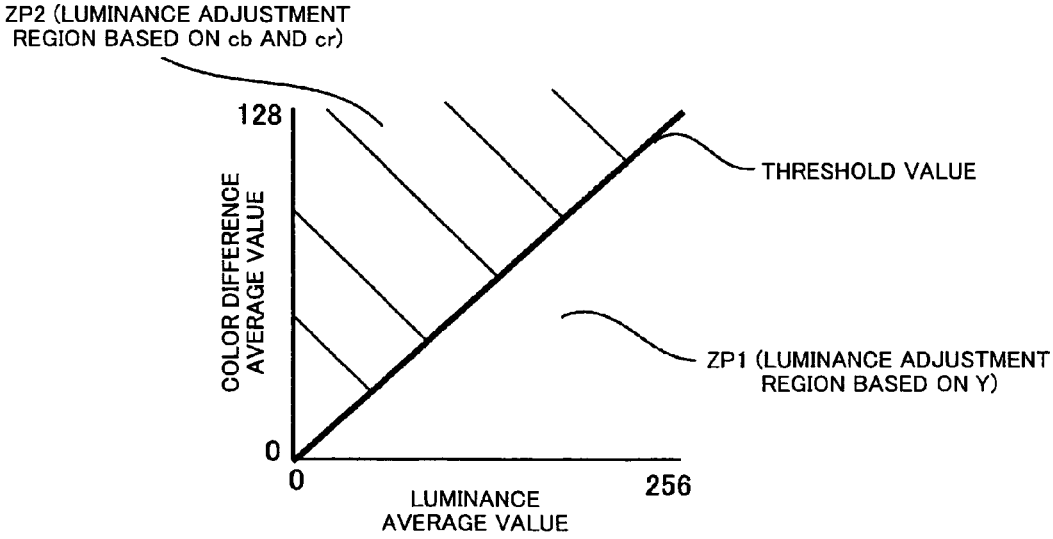

FIGS. 4A to 4C are views illustrative of chroma correction. FIG. 4A shows the output color difference (Cb or Cr) with respect to the input color difference (cb or cr). In FIG. 4A, the difference between a characteristic line indicated by a solid line and a straight line indicated by a dotted line corresponds to the amount of chroma correction Gc in the equation (1). FIG. 4B shows the characteristics of a correction coefficient (Fc) with respect to the input chroma (cb or cr). Since the equation (1) shows chroma correction when luminance adjustment is not taken into consideration, an increase ΔGc in the amount of chroma correction accompanying luminance adjustment must be added to the amount of chroma correction Gc. An increase ΔGc in the amount of chroma correction may be determined by solving an equation under conditions where the average chroma is made equal before and after luminance adjustment.

When the amount of reduction in luminance is determined merely based on the luminance of the image, the luminance of red (R) and blue (B) may be impaired due to too large a reduction in luminance. Specifically, since a dark image is affected by a reduction in luminance to a small extent, the luminance is reduced to a large extent. On the other hand, when a large and bright rose or the like is displayed at the center of a dark image, the amount of reduction in luminance is appropriately limited in order to suppress a decrease in chroma of the rose. However, since red (R) and blue (B) contribute to the luminance (Y) to a small extent, the luminance may be reduced to a large extent when the amount of reduction in luminance is determined merely based on the luminance (Y) (i.e., the image is determined to be a dark image). In order to prevent such an excessive reduction in luminance, the amount of reduction in luminance is determined based on the luminance (Y) and the chroma (red chroma (Cr) and blue chroma (Cb)). When the luminance and the chroma satisfy a specific relationship, the amount of reduction in luminance is limited as a result of giving priority to the chroma. This suppresses a reduction in luminance when the image has a high chroma, whereby a decrease in chroma of the display image is suppressed.

FIG. 4C is a view illustrative of a process of determining whether to give priority to either a reduction in luminance or the chroma using a threshold value determined based on the relationship between the average luminance and the average chroma. As shown in FIG. 4C, a threshold value is set which is determined based on the relationship between the average luminance and the average color difference (i.e., chroma), and whether to reduce the luminance based on either the luminance or the chroma is determined based on the threshold value as a boundary.

In FIG. 4C, a region ZP2 indicated by diagonal lines is a luminance adjustment region based on the chroma (cr, cb), and a region ZP1 is a luminance adjustment region based on the luminance (Y). For example, when the average luminance is 64 (i.e., dark image), the amount of reduction in luminance increases to a considerable extent when determined merely based on the luminance. However, when the average chroma is 96 (i.e., the image has a high chroma), it is necessary to suppress a decrease in chroma due to a reduction in luminance. Therefore, the amount of reduction in luminance is determined based on the chroma (i.e., the amount of reduction in luminance is reduced as compared with the case of determining the amount of reduction in luminance based on the luminance). Specifically, the amount of reduction in luminance based on the luminance is limited based on the chroma to suppress an excessive reduction in luminance which extremely decreases the chroma.

Filtering Process which Prevents Flicker Accompanying Scene Change

When adaptive lighting luminance adjustment and image correction are performed in each frame of a video image, a visual flicker occurs due to sudden changes in lighting luminance and the amount of image correction accompanying a scene change. Therefore, luminance correction and image correction calculated in frame units are appropriately filtered depending on their characteristics. Specifically, since a change in lighting luminance is a change in black and white and is easily observed visually, a filtering process with a large time constant is performed. On the other hand, since a change in the amount of image correction is a change in halftone and is observed with difficulty, a filtering process with a small time constant is performed taking a quick response to a scene change in a video image into consideration. This makes it possible to effectively suppress a flicker accompanying adaptive luminance correction while achieving image correction following a scene change in a video image.

When independently performing each filtering process, the balance between luminance correction and image correction may be impaired, whereby the image quality may deteriorate. Therefore, a first filtering process is performed on the lighting luminance calculated in frame units, the amount of image correction is calculated from the results of the first filtering process, and a second filtering process is performed on the calculated amount of image correction (i.e., configuration of performing series processing). The balance between the first and second filtering processes is always maintained by calculating the amount of reduction in lighting luminance and then calculating the amount of image correction depending on the amount of reduction in luminance.

Figure 5A:
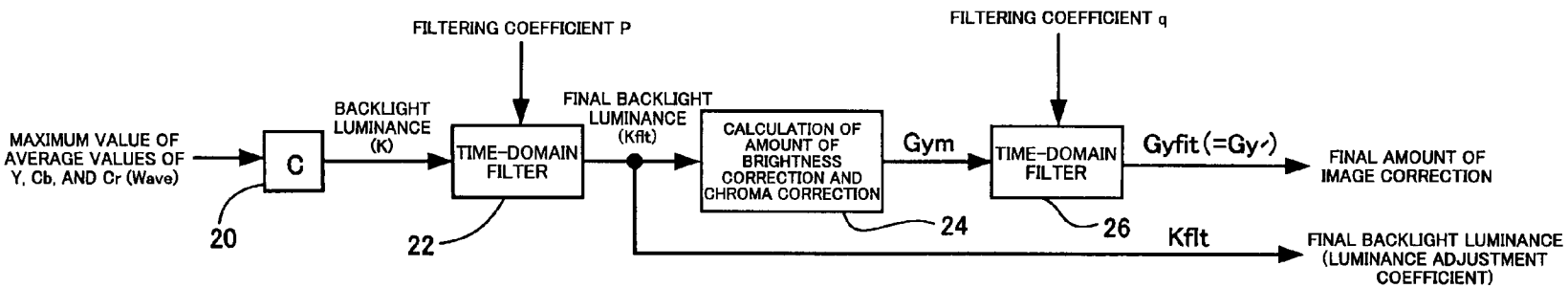
FIGS. 5A to 5D are views illustrative of an outline of an image display control device according to the invention and a filtering process.
Figure 5B:
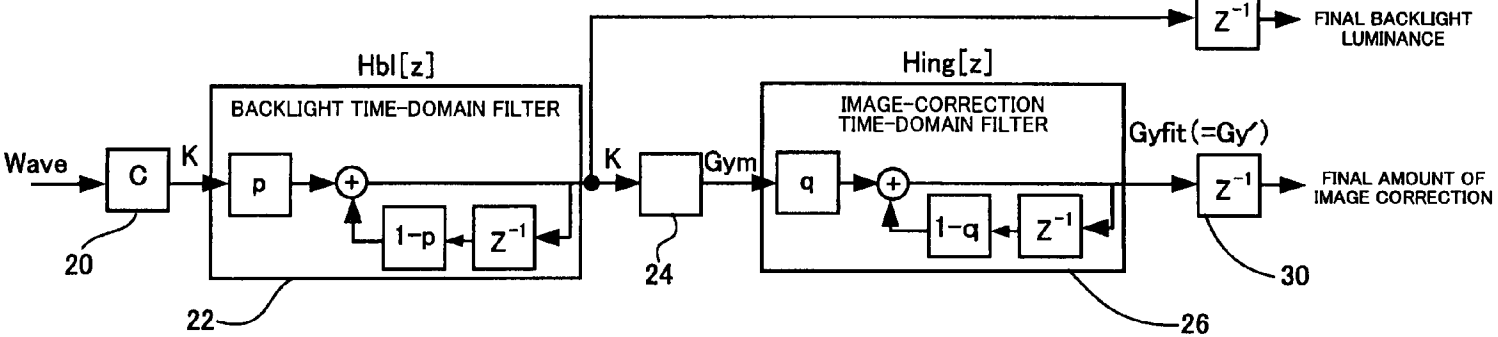
Figure 5C:
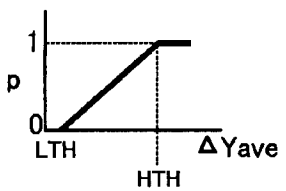
Figure 5D:
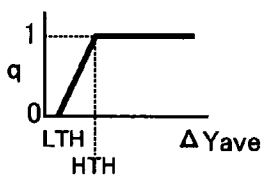

FIGS. 5A to 5D are views illustrative of the outline of the image display control device according to the invention and the filtering process. FIG. 5A is a block diagram showing the entire configuration of the image display control device. FIG. 5B is a block diagram showing the configuration shown in FIG. 5A in more detail. FIG. 5C is a view showing the time constant of the filtering process performed during luminance adjustment. FIG. 5D is a view showing the time constant of the filtering process performed during image correction.

As shown in FIG. 5A, the maximum value (Wave) of the average values of the luminance (Y), the blue chroma (Cb), and the red chroma (Cr) is input. The input signal is subjected to a linear process (C) to calculate the backlight luminance (K). The backlight luminance (K) is filtered using a time-domain filter 22 with a large time constant to obtain the final backlight luminance (luminance adjustment coefficient indicating the backlight luminance after reduction in luminance) Kflt. The characteristics of the time-domain filter 22 are controlled based on a filtering coefficient P. FIG. 5C shows the relationship between the filtering coefficient P and an average luminance change rate (ΔYave) of an image.

An image correction amount calculation section 24 calculates the amount of correction Gm of luminance correction and chroma correction based on the final backlight luminance (Kflt). The amount of image correction Gym is filtered using a time-domain filter 26 with a small time constant, whereby the final amount of image correction (Gy') is calculated. The characteristics of the time-domain filter 26 are controlled based on a filtering coefficient q. FIG. 5D shows the relationship between the filtering coefficient q and the average luminance change rate (ΔYave) of an image.

As shown in FIG. 5B, the backlight time-domain filter 22 is an infinite impulse response (IIR) filter, and the image-correction time-domain filter 26 is also an infinite impulse response (IIR) filter. The transfer function of the backlight time-domain filter 22 is Hbl[z], and the transfer function of the image-correction time-domain filter 26 is Himg[Z]. Therefore, the transfer function of the filtering process of the image display control device is indicated by Hbl[z]·Himg[Z]. The image correction amount calculation section 24 is implemented by a nonlinear transfer function. In FIG. 5B, reference numerals 28 and 30 indicate delay elements.

Embodiments of the invention are described below with reference to the drawings.

First Embodiment

Mounting of Image Display Control Device

FIGS. 6A to 6D are block diagrams illustrative of mounting of the image display device according to the invention.

In FIG. 6A, the image display control device (image display control LSI) is mounted on a portable telephone terminal (example of electronic instrument) 100. The portable telephone terminal 100 includes an antenna AN, a communication/image processing section 102, a CCD camera 104, a host computer 106, an image display control device (image display control LSI) 108, a driver 110 (including a panel driver 112 and a backlight driver 114), a display panel (e.g., liquid crystal panel (LCD)) 116, and a backlight (LED) 118.

In FIG. 6B, the image display control device (image display control LSI) 108 is mounted on a driver device (driver)

110. An image signal and control information are input to the image display control device (image display control LSI) 108 from the host computer 106.

In FIG. 6C, the image display control device (image display control LSI) 108 is mounted on a control device (controller) 130 of the driver 110. In FIG. 6D, the image display control device (image display control LSI) 108 is mounted on a drive control device (device in which a driver and a controller are integrated) 140.

The image display control device (image display control LSI) 108 according to the invention has a real-time capability of processing a video image such as a streaming image and allows a reduction in power consumption and size. Therefore, the added values of the driver device (driver) 110, the control device (controller) 130, the drive control device (device in which a driver and a controller are integrated), and an electronic instrument 100 are increased by mounting the image display control device (image display control LSI) according to the invention.

Entire Configuration of Image Display Control Device

Figure 7:
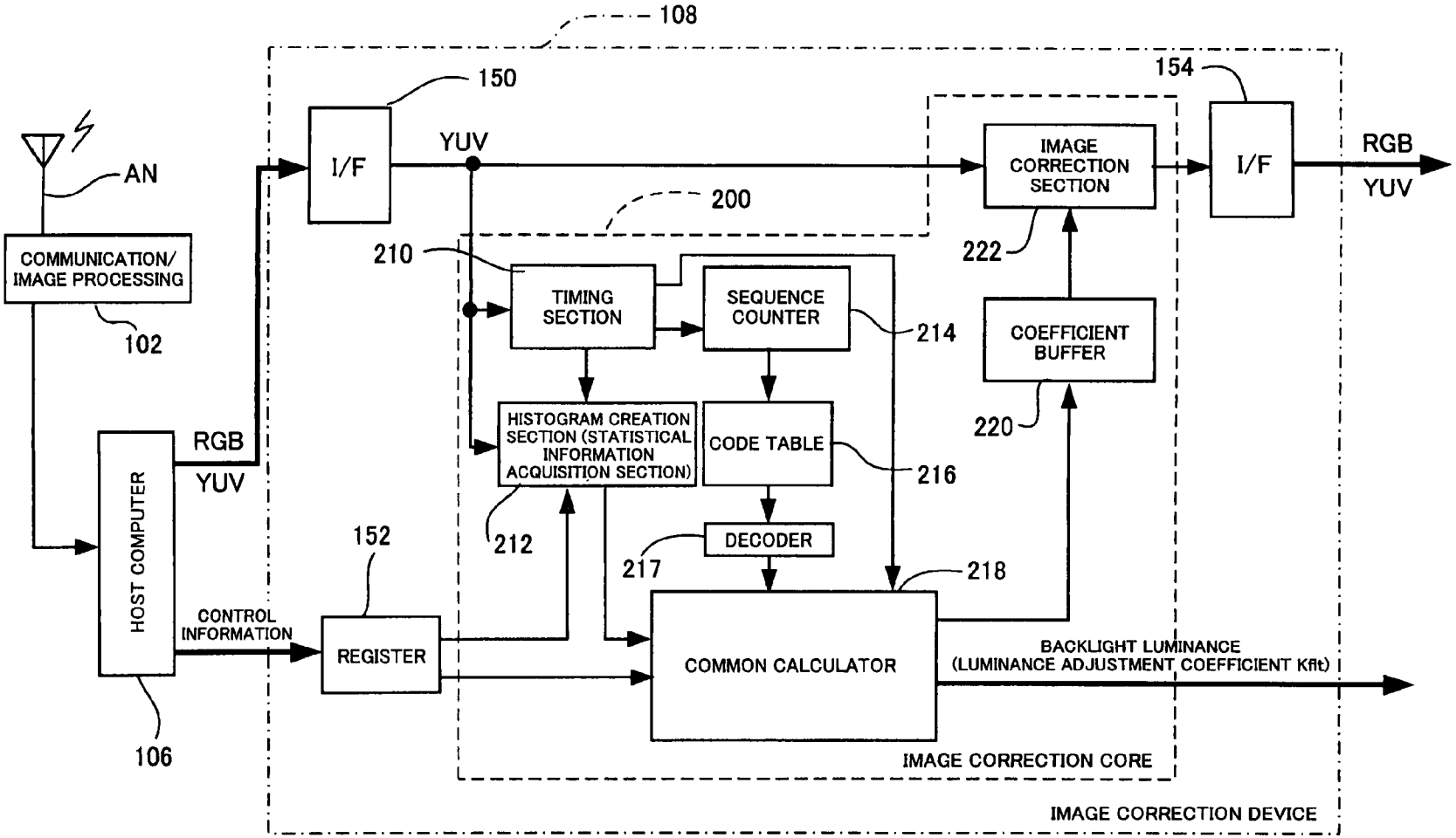
FIG. 7 is a block diagram showing an outline of the entire configuration of an image display control device (image display control LSI) according to the invention.

FIG. 7 is a block diagram showing an outline of the entire configuration of the image display control device (image display control LSI) according to the invention.

The following description is given on the assumption that the image display control device 108 is mounted on a portable terminal (including portable telephone terminal, PDA terminal, and portable computer terminal). The portable terminal includes the antenna AN which receives one-segment broadcasting, the communication/image processing section 102, and the host computer 106, for example. The host computer 102 supplies the received streaming image signal to the image display control device 108, for example. An image signal captured using a CCD camera may also be supplied to the image display control device 108 (see FIG. 6A). In FIG. 7, the CCD camera is omitted.

As shown in FIG. 7, the image display control device 108 includes an image input interface (I/F) 150 which receives an image signal (RGB (color signal format) or YUV (luminance signal/color difference signal format)) supplied from the host computer 106, and converts the RGB image signal into a YUV image signal, a register 152 which temporarily stores control information 152 supplied from the host computer 106, an image correction core 200 which determines the backlight luminance (luminance adjustment coefficient Kflt) after luminance adjustment and performs an image correction process on the image signal to compensate for deterioration in image quality due to a reduction in luminance, and an image output interface (I/F) 154 which converts the YUV image signal into an RGB image signal or directly outputs the YUV image signal.

The image correction core 200 includes a timing section 210 which extracts a synchronization signal from the YUV image signal output from the image input interface (I/F) 150, and generates a timing signal which indicates the operation timing of each section, a histogram creation section (statistical information acquisition section) 212 which acquires statistical information necessary for calculations, a sequence counter 214, a code table 216 which stores microcodes into which a correction algorithm is subdivided, a decoder 217 which decodes the microcodes to generate an instruction and data, a common calculator 218 which includes minimum circuits and is used in common for a luminance adjustment process and an image correction process, a coefficient buffer 220 which temporarily stores an image correction coefficient generated by calculations, and an image correction section 222 which corrects the image signal using the correction coefficient.

Figure 8:
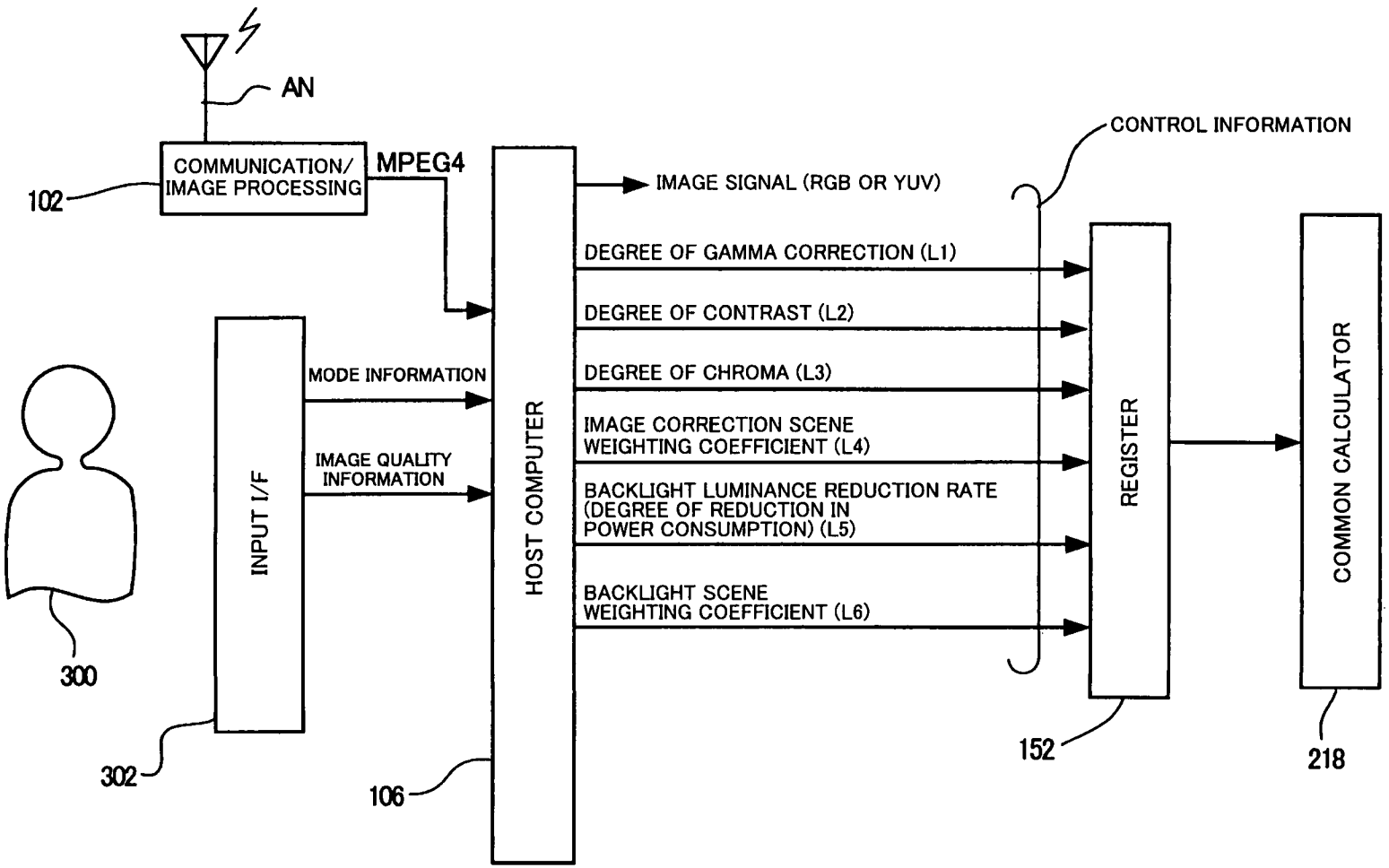
FIG. 8 is a view showing a control signal supplied from a host computer to an image display control device.

FIG. 8 is a view showing a control signal supplied from the host computer to the image display control device. An image signal conforming to the MPEG-4 standard or the like is input to the host computer 106 from the communication/image processing section 102. Mode information (e.g., mode signal which specifies a high-definition display mode) and image quality information (e.g., information indicating the degree of gamma correction, contrast, and chroma and scene weighting coefficient information) are also input to the host computer 106 from an image input interface (I/F) 302.

The host computer 106 outputs an image signal (RGB format or YUV format). The host computer 106 also outputs the control information including a degree of gamma correction (L1), a degree of contrast (L2), a degree of chroma (L3), an image correction scene weighting coefficient (L4), a backlight luminance reduction rate (degree of reduction in power consumption: L5), and a backlight scene weighting coefficient (L6). The image correction scene weighting coefficient (L4) and the backlight scene weighting coefficient (L6) respectively correspond to the filtering coefficients P and Q shown in FIG. 5.

The control information is temporarily stored in the register 152, and supplied to the common calculator 218. The common calculator 218 performs specific calculations using the instruction and data from the decoder 217 based on the supplied control information, and generates the image correction coefficient and the backlight luminance (luminance adjustment coefficient Kflt).

Figure 9:
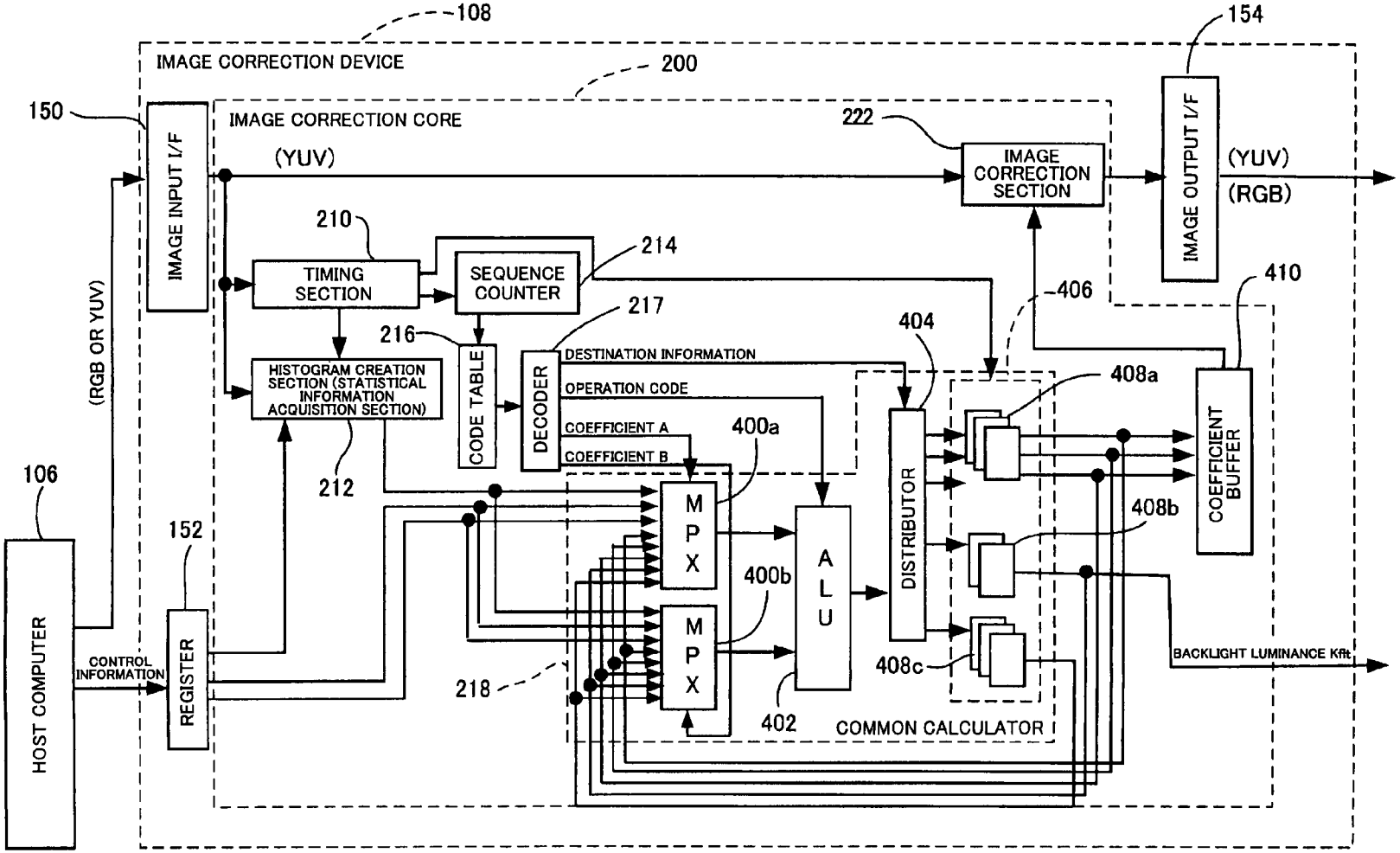
FIG. 9 is a block diagram showing a specific configuration of the image display control device shown in FIG. 7.

FIG. 9 is a block diagram showing a specific configuration of the image display control device shown in FIG. 7. FIG. 9 shows the configuration of the image correction core 200 in detail. In FIG. 9, the same sections as in FIG. 7 are indicated by the same reference numerals.

In FIG. 9, the common calculator 218 includes first and second multiplexers (400*a* and 400*b*), an arithmetic logic unit (ALU) 402, a distributor 404 which distributes the calculation results of the arithmetic logic unit (ALU), and a plurality of output destination registers (destination registers) 406. The output destination registers 406 include register groups 408*a* to 408*c* classified in output destination units. A feedback path is formed through which the calculation results stored in the register groups 408*a* to 408*c* are at least partially fed back to the input side of the first and second multiplexers (400*a* and 400*b*).

The function and the operation of each section of the image correction core 200 shown in FIG. 9 are described below in detail.

The histogram creation section (statistical information acquisition section) 212 acquires statistical information (i.e., statistical information relating to luminance and statistical information relating to chroma) of an image signal of one frame. A specific internal configuration of the histogram creation section (statistical information acquisition section) 212 is described later.

The code table (code storage section) 216 stores a plurality of microcodes which specify the operation procedure of the common calculator 218. A procedure of creating the code table 216 is described later in a second embodiment.

The sequence counter (sequence instruction section) 214 specifies the code table 216, and controls the order of output of the microcodes from the code table 216. The decoder 217 decodes the microcodes sequentially output from the code table 216, and generates at least one of an instruction and data (e.g., coefficient) supplied to the common calculator.

The decoder 217 supplies a coefficient used for calculations to the first and second multiplexers (400*a* and 400*b*), supplies an operation instruction (operation code) to the arithmetic logic unit (ALU) 402, and supplies destination information to the distributor 404.

The common calculator 218 calculates the image correction coefficient and the backlight luminance (luminance adjustment coefficient Kflt) after reduction in luminance in real time. The digital signal processing described with reference to FIGS. 5A to 5D is performed by the calculations performed by the common calculator 218. Moreover, the chroma enhancement process, the process of limiting the backlight luminance reduction rate in order to prevent deterioration in image quality of a high-chroma image, and the process of serially performing the first and second infinite impulse response filtering processes described with reference to FIGS. 2 to 5 are substantially performed.

The calculations performed by the common calculator 218 are controlled by the microcodes of the signal processing procedure, as described above. Real-time calculations can be performed without parallelly providing the same type of hardware by utilizing a common calculator having a minimum circuit configuration. Therefore, high-speed luminance adjustment control and image correction can be implemented using a minimum number of circuits and with minimum power consumption.

The calculation results of the common calculator 218 are temporarily stored in the register groups 408*a* to 408*c* classified in output destination units. The calculated backlight luminance (luminance adjustment coefficient Kflt) is output to a backlight (LED) driver, and the correction coefficient is stored in the coefficient buffer 410. The correction coefficient stored in the coefficient buffer 410 is supplied to the image correction section 222 in synchronization with the input of an image signal of the next frame, and image correction (enhancement of luminance and chroma) is performed.

The calculation results stored in the register groups 408*a* to 408*c* are at least partially fed back to the input side of the first and second multiplexers (400*a* and 400*b*) through the feedback path. The process of calculating the lighting luminance after reduction in luminance, feeding back the calculation results to the input side, and calculating the image correction coefficient based on the calculated luminance is thus performed. The first and second infinite impulse response (IIR) filtering processes are also performed.

Figure 10:
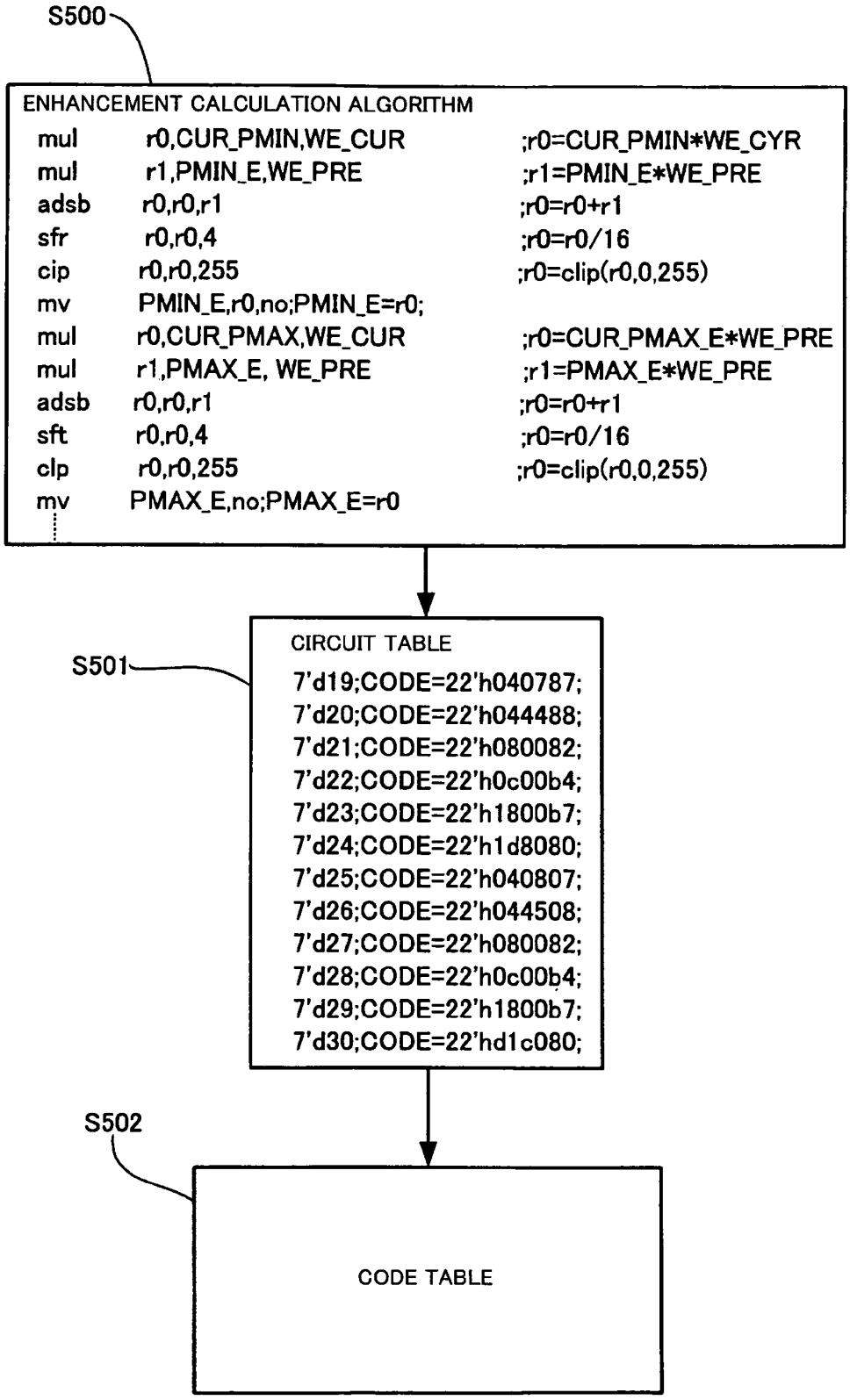
FIG. 10 is a view showing a procedure of creating a code table.

A procedure of creating the code table shown in FIG. 9 is described below. FIG. 10 is a view showing the procedure of creating the code table.

In FIG. 10, an algorithm (enhancement calculation algorithm) using a programming language (e.g., high-level programming language) for adaptively reducing the luminance of the image display backlight corresponding to the display image and correcting the image signal to compensate for deterioration in image quality due to a reduction in backlight luminance is provided (step S500).

The algorithm created using the programming language is collectively converted to generate microcodes (step S502).

The generated microcodes are written into a read only memory (ROM) (step S502).

The code table 216 can be efficiently created in this manner. Moreover, the calculations of the common calculator 218 can be relatively easily changed by changing the algorithm (microcodes). This makes it possible to flexibly deal with a change in design.

Configuration and Operation of Histogram Creation Section (Statistical Information Acquisition Section)

An example of a specific internal configuration of the histogram creation section (statistical information acquisition section) 212 shown in FIG. 9 is described below.

As described above, the image display control device according to the invention acquires the statistical values relating to the luminance and the chroma of the image signal of one frame, and adaptively corrects the backlight luminance and the image signal (chroma and luminance) based on the statistical values. When the image has a low average luminance but has a high average chroma, the image display control device limits the backlight luminance reduction rate when correcting the image as a result of giving priority to the chroma over a reduction in power consumption. In order to perform such control, it is necessary to quickly acquire the necessary statistical value information relating to the luminance and the chroma.

Figure 11:
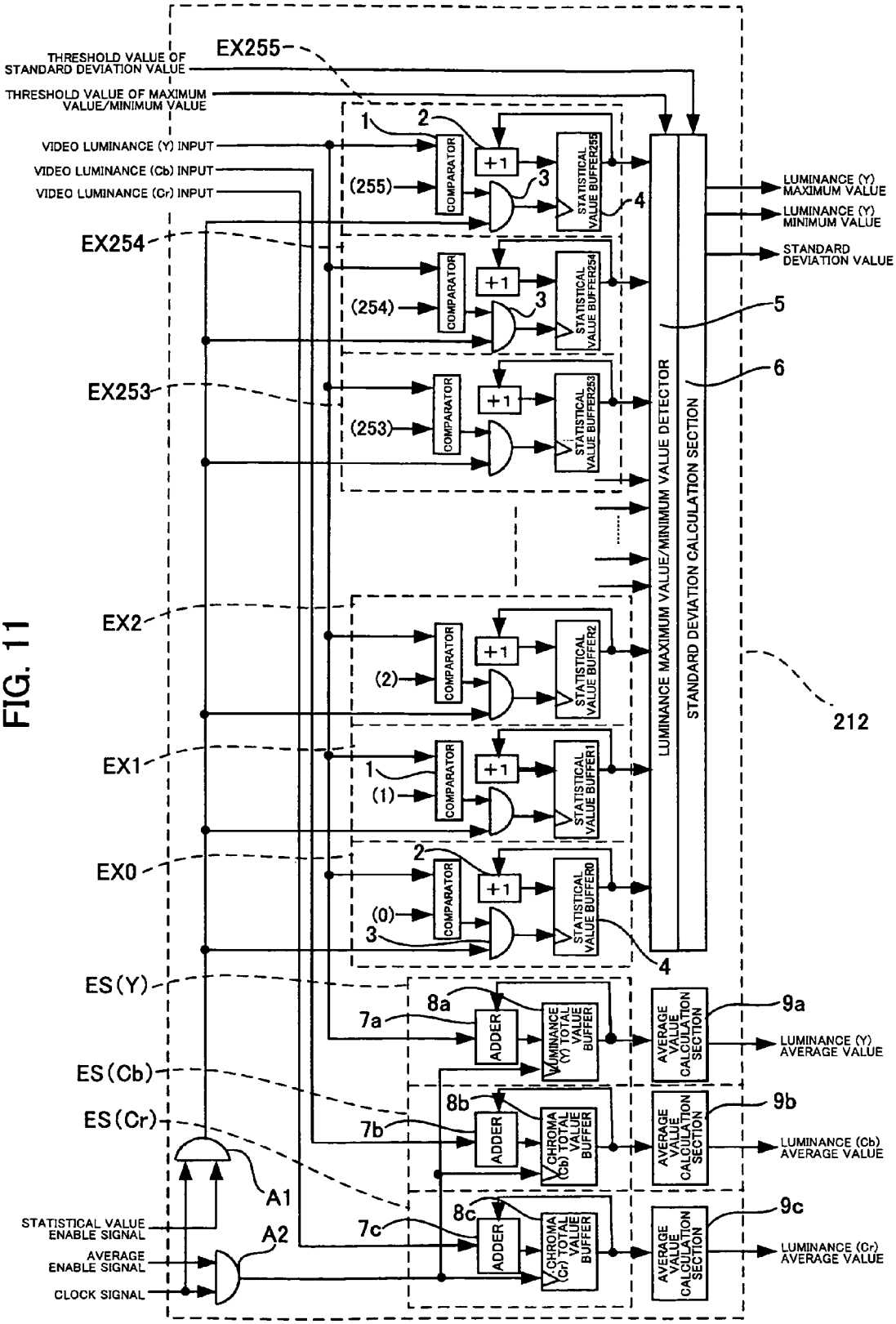
FIG. 11 is a circuit diagram showing an example of a specific internal configuration of a histogram creation section (statistical information acquisition section) shown in FIG. 9.

FIG. 11 is a circuit diagram showing a specific internal configuration of the histogram creation section (statistical information acquisition section) shown in FIG. 9. As shown in FIG. 11, the histogram creation section includes luminance histogram creation statistical units (EX0 to EX255). The statistical units EX0 to EX255 have an identical circuit configuration.

Specifically, each of the luminance histogram creation statistical units (EX0 to EX255) includes a comparator 1 which compares the luminance of the input image signal with a reference luminance (the reference luminance differs depending on the statistical unit), an up-counter 2, an AND gate 3, and a statistical value buffer 4. The luminance is expressed by 256 grayscales. The reference luminances (1) to (255) corresponding to the respective grayscales are respectively supplied to the comparators (EX0 to EX255).

The luminance signal (Y) of the image signal is parallelly input to the statistical units (EX0 to EX255), and is simultaneously compared by the comparators 1 with the reference luminances (1) to (255) corresponding to the respective grayscales. Each comparator 1 functions as a luminance coincidence detection circuit. The output of the comparator is set at a high level when the input luminance coincides with the reference luminance, whereby an operation clock signal supplied to the other input terminal of the AND gate 3 is supplied to the statistical value buffer 4.

The statistical value buffer 4 acquires and temporarily holds the count value of the up-counter 2 at a timing at which the clock signal is supplied (i.e., the statistical value buffer 4 functions as a register). The luminance of each pixel contained in the image signal is thus classified and counted in grayscale units. Since the luminance of the input image is parallelly input to each statistical unit and each statistical unit simultaneously performs the count operation, the statistical values can be acquired at an extremely high speed.

A luminance maximum value/minimum value detector 5 calculates the maximum value and the minimum value of the luminance (Y) based on the count value of each statistical unit (EX0 to EX255). A standard deviation calculation section 6 calculates a standard deviation value which indicates the distribution of the luminance (Y). The luminance distribution of the image of one frame can be estimated (specified) based on the maximum value/minimum value/standard deviation value of the luminance (Y). Adaptive luminance adjustment and image correction are performed using the statistical values thus calculated.

As shown in FIG. 11 (lower side), the statistical information acquisition section 212 further includes a statistical unit ES(Y) which calculates the average value of the luminance (Y), a statistical unit ES(Cb) which calculates the average value of the blue chroma (Cb), and a statistical unit ES(Cr) which calculates the average value of the red chroma (Cr). As described above, when the image has a low average luminance but has a high average chroma (particularly the average values of the blue chroma and the red chroma which contribute to the luminance to a small extent), it is necessary to reduce the luminance reduction rate as a result of giving priority to maintaining the chroma. Since it is necessary to compare the average values of the luminance and the chroma in order to perform such high-level luminance adjustment control, the statistical units ES(Y), ES(Cb), and ES(Cr) are provided so that the average values of the luminance and the chroma can be quickly acquired.

Each statistical unit (ES(Y), ES(Cb), and ES(Cr)) has an identical configuration. Specifically, each statistical unit (ES(Y), ES(Cb), and ES(Cr)) includes an adder (7*a* to 7*c*) which accumulates the Y, Cb, or Cr values, and a total value buffer (8*a* to 8*c*) which stores the accumulated value. Average value calculation sections (9*a* to 9*c*) respectively calculate and output the average value of the luminance (Y), the average value of the chroma (Cb), and the average value of the chroma (Cr).

As described with reference to FIG. 4C, whether the luminance (Y) or the chroma (Cb and Cr) is used to calculate the luminance adjustment coefficient is selected based on the relationship between the luminance (Y) and the chroma (Cb and Cr). The average value of the luminance (Y), the average value of the chroma (Cb), and the average value of the chroma (Cr) are used for such a determination.

The count value of the luminance can be acquired at an extremely high speed by parallelly inputting the image signal to each statistical unit and causing each statistical unit to simultaneously and parallelly update the count value of the luminance. Moreover, adaptive image correction based on the chroma can be performed by acquiring the statistical information relating to the chroma (color difference) in addition to the statistical information relating to the luminance. Since the statistical unit and the total value unit are compact circuits and have an identical configuration, a high-density circuit layout can be achieved.

An AND gate A1 shown at the lower left in FIG. 11 is provided to gate the operation clock signal supplied to each statistical unit (EX0 to EX255) using a statistical value enable signal to suspend the supply of the clock signal, if necessary. Likewise, an AND gate A2 is provided to gate the operation clock signal supplied to each statistical unit (ES(Y), ES(Cb), and ES(Cr)) using an average enable signal to suspend the supply of the clock signal, if necessary. Power consumption can be reduced by suspending the supply of the clock signal to suspend the statistical value acquisition operation when it is unnecessary to acquire the statistical value. This feature is described below in detail with reference to FIG. 12.

Figure 12:
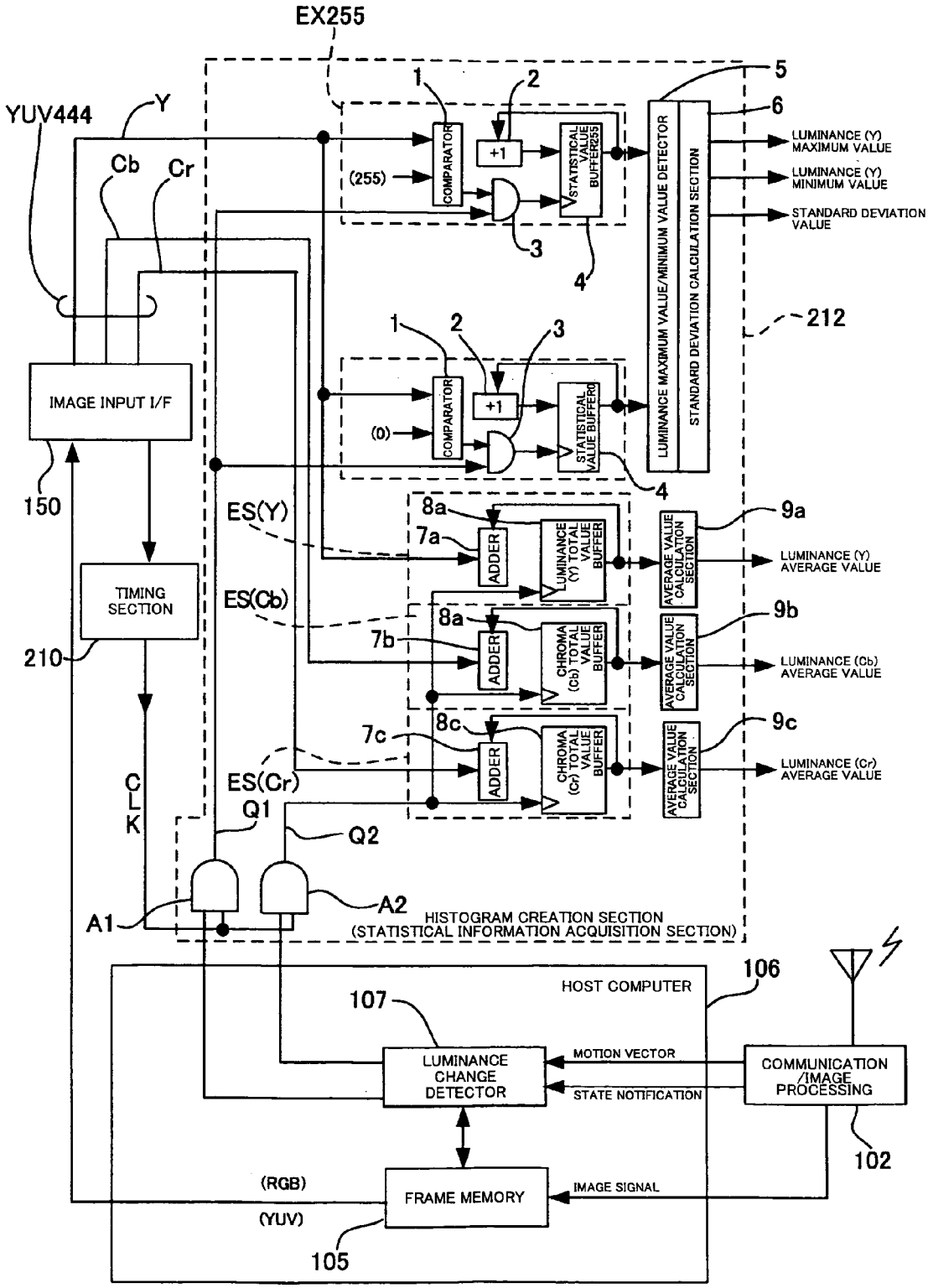
FIG. 12 is a block diagram showing a configuration which causes a statistical value count operation of a histogram creation section (statistical information acquisition section) to be suspended when a statistical value acquisition operation is unnecessary in order to further reduce power consumption.

FIG. 12 is a block diagram showing a configuration which causes the statistical value count operation of the histogram creation section (statistical information acquisition section) to be suspended when the statistical value acquisition operation is unnecessary in order to further reduce power consumption. In FIG. 12, the same sections as in other drawings are indicated by the same reference numerals.

Figure 15:
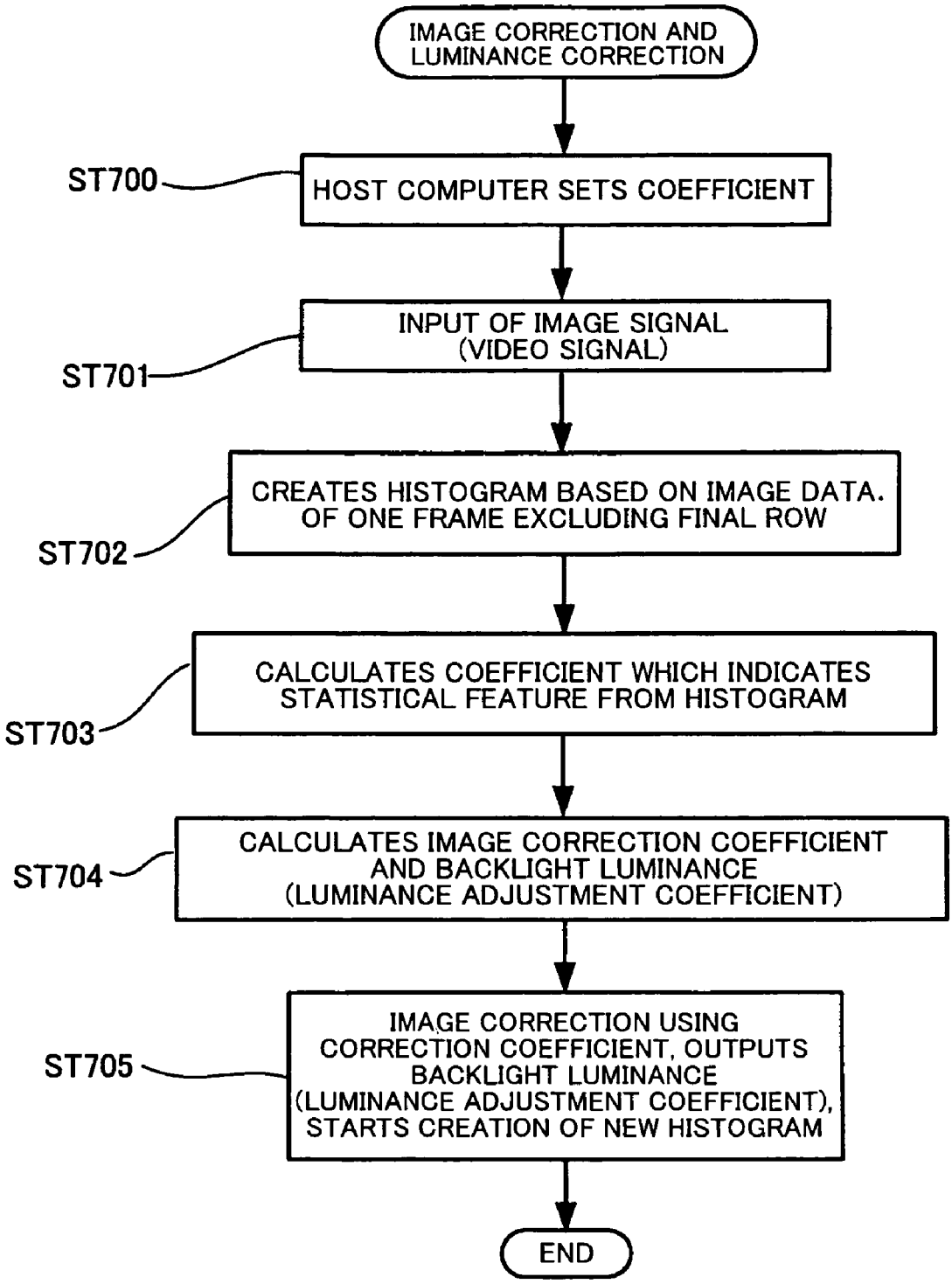
FIG. 15 is a flowchart showing a specific procedure of a process of terminating a statistical value acquisition process in the middle of one frame period, calculating a correction coefficient and a luminance adjustment coefficient until one frame period expires, and correcting an image of the next frame using the calculated correction coefficient.

As described with reference to FIG. 11, the histogram creation section (statistical information acquisition section) 212 includes the AND gates A1 and A2 which gate the operation clock signal (CLK). In FIG. 15, the operation clock signal (CLK) is supplied from the timing section 210. The timing section 210 generates the operation clock signal (CLK) by separating a synchronization clock signal contained in the image signal input to the image input interface (I/F).

The AND gate A1 gates the operation clock signal supplied to each statistical unit (EX0 to EX255) using the statistical value enable signal (first enable signal). Likewise, the AND gate A2 is provided to gate the operation clock signal supplied to each statistical unit (ES(Y), ES(Cb), and ES(Cr)) using the average enable signal (second enable signal).

The statistical value enable signal and the average enable signal are output from a luminance change detector 107 included in the host computer 106, for example. The luminance change detector 107 determines whether or not a change in image occurs between consecutive frames based on a motion vector transmitted from a codec included in the communication/image processing section 102.

The luminance change detector 107 may determine that a change in image does not occur based on a state notification signal transmitted from the communication/image processing section 102. For example, when the state notification signal indicates a pause (stop motion) mode, the luminance change detector 107 may determine that reproduction of a video image is temporarily suspended so that a change in image does not occur between consecutive frames.

The luminance change detector 107 may detect the presence or absence of a change in image by directly monitoring image data stored in a frame memory 105.

Since it is unnecessary to create a new statistical value when the luminance change detector 107 has determined that a change in image does not occur between consecutive frames, the output of the operation clock signals Q1 and Q2 from the AND gates A1 and A2 is prohibited by setting the statistical value enable signal and the average enable signal at a low level. This causes each statistical unit (EX0 to EX255, ES(Y), ES(Cb), and ES(Cr)) to suspend its count operation. Therefore, power consumption can be further reduced.

Since each unit which performs the count operation has an identical configuration and operates based on a common operation clock signal, the count operation can be suspended simultaneously by gating the operation clock signal to suspend the supply of the operation clock signal. Therefore, unnecessary power consumption can be effectively reduced. Moreover, the circuit configuration is simplified and is easily implemented.

Second Embodiment

When performing adaptive image correction, it is necessary to acquire the statistical value of the preceding frame, calculate the correction coefficient using the acquired statistical value, and correct the image of the next frame using the correction coefficient. This makes it necessary to delay the correction of the image of the next frame until the correction coefficient is calculated after the image of one frame has been completely input. Specifically, image correction of a video image is delayed for a period of time required to calculate the correction coefficient. In order to prevent such a delay, this embodiment employs the following configuration in addition to the configuration according to the above embodiment.

Configuration which Enables Real-time Process

A configuration which enables a real-time process is described below with reference to FIGS. 13 to 15.

Figure 13:
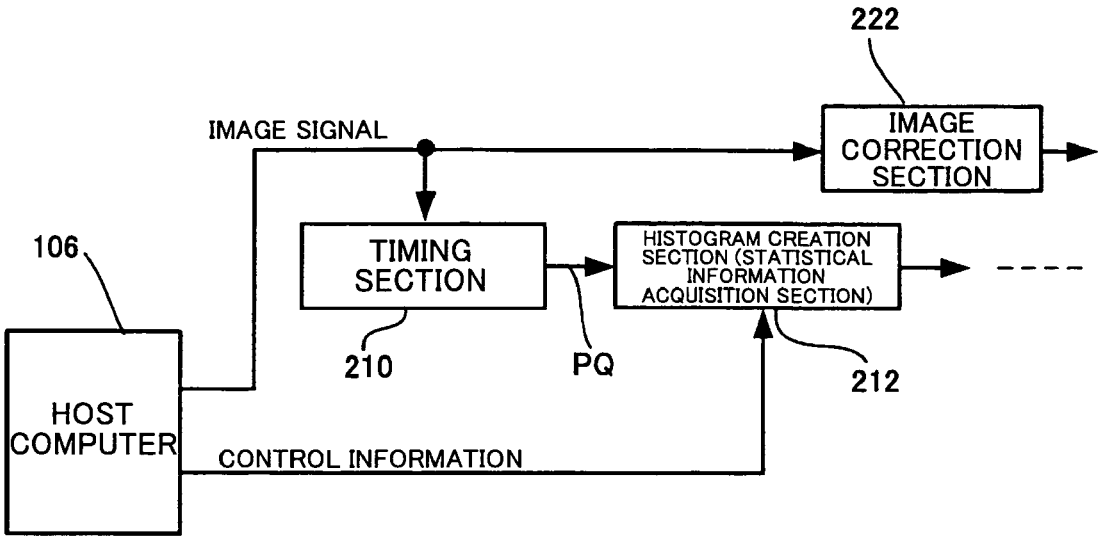
FIG. 13 is a block diagram showing the main configuration around a histogram creation section (statistical information acquisition section).

FIG. 13 is a block diagram showing the main configuration around the histogram creation section (statistical information acquisition section). As shown in FIG. 13, the histogram creation section (statistical information acquisition section) 212 receives the control information from the host computer 106. The histogram creation section (statistical information acquisition section) 212 creates the luminance histogram and the like and outputs the statistical value information to the calculator based on the timing information from the timing section 210 (the timing section 210 is not an indispensable element; the histogram creation section (statistical information acquisition section) 212 may generate a timing signal).

A real-time process can be enabled by controlling the statistical value acquisition finish timing of the histogram creation section (statistical information acquisition section) 212.

Specifically, if the histogram creation section (statistical information acquisition section) 212 finishes the statistical value acquisition process without acquiring the statistical value of the entire image of one frame when acquiring the statistical information of the image of one frame, the histogram creation section (statistical information acquisition section) 212 can calculate the correction coefficient based on the acquired statistical value within the remaining time until one frame ends.

The accuracy of the statistical value is not affected to a large extent even if part of the image of one frame (e.g., image of the peripheral portion) is excluded from the statistical information acquisition target. Therefore, the accuracy of the statistical value can be ensured.

Figure 14:
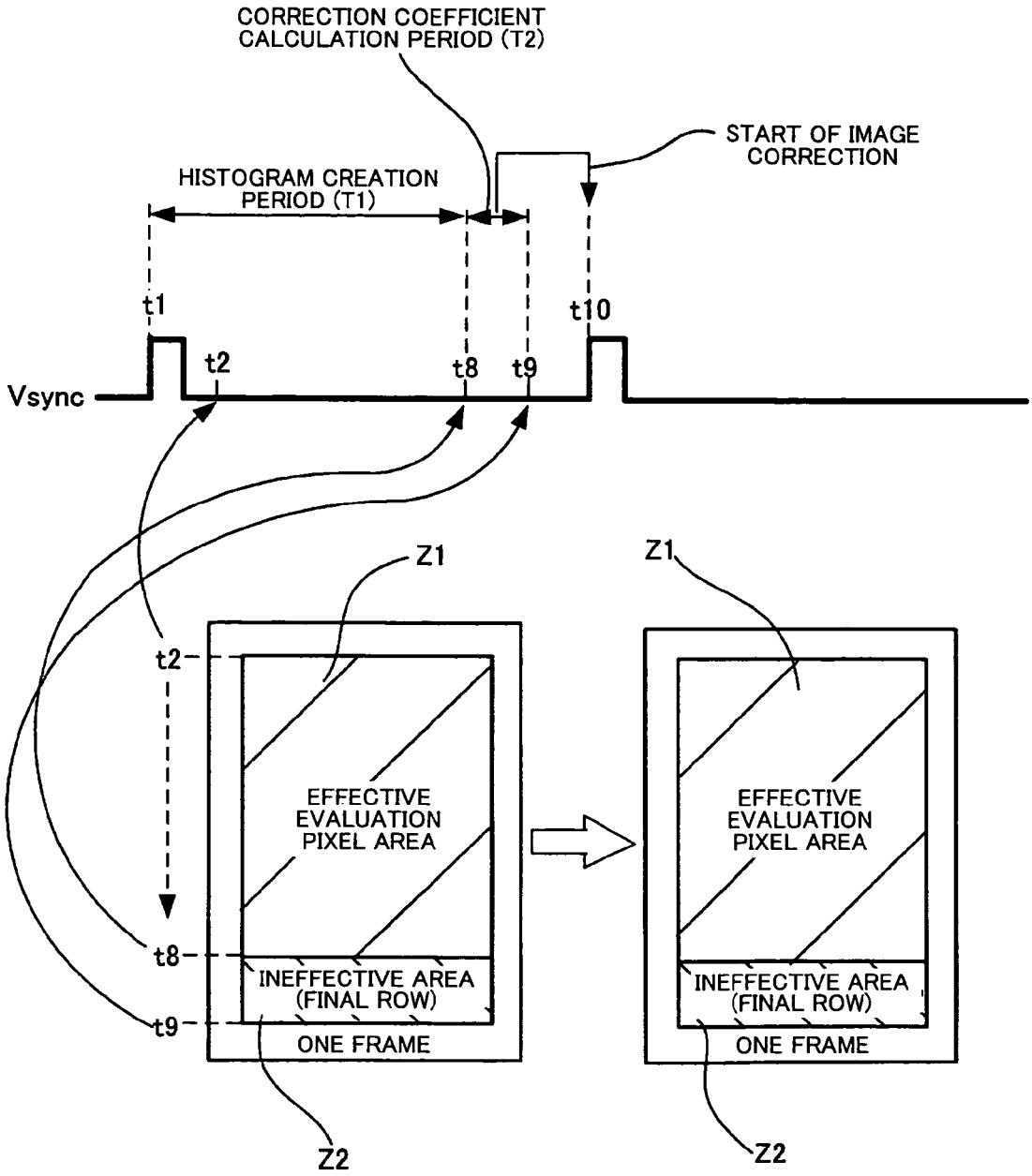
FIG. 14 is a view showing an example of timing control of a histogram creation section (statistical information acquisition section) which enables real-time image correction based on a statistical value.

FIG. 14 is a view showing an example of timing control of the histogram creation section (statistical information acquisition section) which enables real-time image correction based on the statistical value. As shown in FIG. 13 (lower side), an effective evaluation pixel area Z1 is set in an image of one frame. An area other than the effective evaluation pixel area Z1 is an ineffective area Z2. The statistical value acquisition target pixels consist of only pixels included in the effective evaluation pixel area Z1, and pixels included in the ineffective area Z2 are not used to create the statistical value.

In this embodiment, the final row of one frame is set to be the ineffective area Z2, as shown in FIG. 14. Since it is desirable to acquire the statistical value of the entire image as much as possible, only the final row is excluded from the statistical value acquisition target. Note that the ineffective area is not limited thereto. Since calculations can be implemented at an extremely high speed by employing a configuration using a microprogram-controlled calculation circuit without using a LUT (configuration shown in FIGS. 7 and 9), the lighting luminance after reduction in luminance and the correction coefficient can be calculated by providing a period of time corresponding to one row.

In FIG. 14, times t1 and t10 indicate the timings of a vertical synchronization signal (Vsync) for the input image signal. The statistical value of the effective evaluation pixel area Z1 is acquired (i.e., statistical value counting and acquisition of the luminance maximum value/minimum value, standard deviation value, luminance average value, blue chroma (Cb) average value, and red chroma (Cr) average value using the configuration shown in FIG. 11 are performed) between times t2 and t8.

The statistical value acquisition process ends at the time t8. The common calculator 218 shown in FIG. 9 performs ultra-high-speed calculations based on the acquired statistical value to calculate the backlight luminance (luminance adjustment coefficient Kfit) and the correction coefficient within a period of time (between times t8 and t9) corresponding to the final row which is the ineffective area, for example.

When the next frame starts at the time t10, the image correction section 222 shown in FIG. 9 corrects the image signal using the calculated correction coefficient. Specifically, the image correction section 222 performs image correction which enhances the luminance and the chroma depending on the degree of reduction in luminance.

Since acquisition of the statistical value and calculation of the correction coefficient are completed within the period corresponding to one frame, image correction can be immediately started even if the image of the next frame is input without a delay. Therefore, real-time video image correction is implemented.

The above description has been given taking an example in which the statistical value is acquired based on the preceding frame. Note that the statistical value may be acquired based on the two preceding frames.

FIG. 15 shows a summary of the above-described operation. FIG. 15 is a flowchart showing a specific procedure of the process of terminating the statistical value acquisition process in the middle of one frame period, calculating the correction coefficient and the luminance adjustment coefficient until one frame period expires, and correcting the image of the next frame using the calculated correction coefficient.

The following description is given on the assumption that the process shown in FIG. 15 is implemented using the configuration shown in FIG. 9. As in FIG. 15, the host computer sets necessary coefficients (e.g., the threshold values of the standard deviation value and the maximum value/minimum value necessary for calculating the statistical value) (step ST700).

An image signal (video signal) is input (step ST701). A histogram (statistical value calculation basic data) which indicates the luminance distribution of the image signal, the luminance cumulative value, and the chroma cumulative value is created based on the image data of one frame excluding the final row (step ST702). A coefficient (statistical value) which indicates the statistical feature is calculated from the created histogram (step ST703). The calculated statistical value is supplied to the calculator 218 shown in FIG. 9, and the correction coefficient and the backlight luminance (luminance adjustment coefficient) are calculated based on the statistical value (step ST704).

The process in the step ST704 is completed within one frame period. Input of an image signal of the next frame is then started, and real-time image correction using the correction coefficient is performed on the image signal. At the same time, the backlight luminance (luminance adjustment coefficient) is output to the LED driver, and creation of a new histogram is started (step ST705).

As described above, adaptive video image correction based on the statistical value can be implemented without causing a delay time by employing the configuration according to this embodiment.

The invention has been described above based on the embodiments. Note that the invention is not limited to the above embodiments. Various modifications, variations, and applications may be made without departing from the spirit and scope of the invention. A calculation circuit using a look-up table may be used instead of the above calculator insofar as the correction coefficient can be quickly calculated. Specifically, the term "calculator" used herein also includes calculation means other than the microprogram-controlled calculator described in the above embodiments.

According to at least one aspect of the invention, the following effects can be obtained, for example.

(1) The luminance count value can be acquired at an extremely high speed by parallelly inputting the image signal to each statistical unit and causing each statistical unit to simultaneously and parallelly update the luminance count value.

(2) Adaptive image correction based on the chroma can be implemented by acquiring the statistical information relating to the chroma (color difference) in addition to the statistical information relating to the luminance.

(3) Since the statistical unit and the total value unit are compact circuits and have an identical configuration, a high-density circuit layout can be achieved.

(4) Unnecessary power consumption can be reduced by suspending the count operations of the statistical units and the total value units when it is unnecessary to acquire the statistical information. Since the statistical units and the total value units have an identical configuration and operate based on a common operation clock signal, the count operations can be simultaneously and easily suspended by suspending the supply of the operation clock signal by gating.

(5) High-level calculations based on the statistical value can be implemented in real time at low power consumption by applying the technology according to the invention to image display control when simultaneously performing adaptive reduction in backlight luminance aimed at reducing power consumption and adaptive image correction aimed at preventing deterioration in image quality due to a reduction in backlight luminance.

(6) Real-time calculations can be implemented without parallelly providing the same type of hardware by utilizing a microprogram-controlled calculator, whereby high-speed adaptive luminance adjustment control and adaptive image correction can be implemented using a minimum number of circuits and with minimum power consumption.

(7) Power consumption can be significantly reduced by adaptive lighting luminance adjustment while minimizing deterioration in image quality by performing adaptive reduction in luminance and image correction at the same time (it has been confirmed that power consumption is reduced by 30% at maximum). Since the process can be implemented using minimum hardware, the space occupied by the device can be reduced. Moreover, a delay time does not occur when processing a video image such as a streaming image, whereby a highly accurate real-time process is implemented.

(8) An increase in added values of a driver device (driver), a control device (controller), and a drive control device (device in which a driver and a controller are integrated) of a liquid crystal display device and the like can be realized.

(9) A streaming image distributed by one-segment broadcasting and the like can be displayed with high quality and the life of a battery can be increased by mounting the image display control device (LSI) according to the invention on a portable terminal (including portable telephone terminal, PDA terminal, and portable computer terminal).

(10) Real-time video image correction based on the statistical value can be implemented. Moreover, a real-time capability, a reduction in circuit scale, and a reduction in power consumption can be implemented even when simultaneously performing adaptive reduction in lighting luminance aimed at reducing power consumption and adaptive image correction aimed at preventing deterioration in image quality due to a reduction in lighting luminance.

(11) Technology capable of quickly acquiring the statistical information of a video image at low power consumption can be provided.

(12) Various types of statistical information of a video image can be quickly and efficiently acquired while preventing complication of a circuit configuration. Moreover, calculations using the statistical information can be quickly and efficiently performed. Therefore, adaptive reduction in lighting luminance and highly accurate image correction which compensates for deterioration in image quality due to a reduction in lighting luminance can be implemented at the same time while reducing power consumption and suppressing an increase in circuit scale.

The invention is useful as technology for acquiring various types of statistical information of a video image at an extremely high speed, and may be widely utilized for image correction and luminance adjustment control. The invention is effective when adaptively correcting a video image in real time. For example, the invention is suitably applied to an image display control device which implements streaming reproduction. The invention is also useful for an image display control device (image display control LSI) or the like which adaptively reduces the display lighting luminance corresponding to the display image and corrects the image signal to compensate for deterioration in image quality due to a reduction in luminance. The invention is also useful for a driver device (driver) of a display panel, a control device (controller) of a display panel, a drive control device (device in which a driver and a controller are integrated) of a display panel, an electronic instrument such as a portable terminal, and the like.

Although only some embodiments of the invention have been described above in detail, those skilled in the art would readily appreciate that many modifications are possible in the embodiments without materially departing from the novel teachings and advantages of the invention. Accordingly, such modifications are intended to be included within the scope of the invention.

What is claimed is:

1. An image display control device that corrects an image signal based on statistical information, the image display control device comprising:

a statistical information acquisition section that acquires the statistical information of the image signal in a frame unit;

a calculator that generates a correction coefficient used to correct the image signal using the statistical information of a preceding frame output from the statistical information acquisition section; and an image correction section that corrects the image signal using the correction coefficient, the statistical information acquisition section including:

a plurality of statistical units, each of the plurality of statistical units including a comparator that compares a luminance of the image signal with a reference luminance and outputs a comparison result;

a statistical value buffer that updates a count value based on the comparison result; and a statistical value calculation section that calculates a specific statistical value based on the count value of the statistical value buffer that is output from each of the plurality of statistical units, the reference luminance of each of the plurality of statistical units being set to be a different value, and the image signal being parallelly input to each of the plurality of statistical units, the statistical information acquisition section further acquiring statistical information relating to a blue chroma and statistical information relating to a red chroma included in the image signal, and the statistical information acquisition section having a configuration that acquires the statistical information relating to the blue chroma and the statistical information relating to the red chroma, the statistical information acquisition section including:

a luminance total value init that includes an adder that accumulates a luminance of each pixel, and a luminance total value buffer that stores the accumulated value as a luminance total value;

a blue chroma total value unit that includes an adder that accumulates a blue chroma of each pixel, and a blue chroma total value buffer that stores the accumulated value as a blue chroma total value;

a red chroma total value unit that includes an adder that accumulated a red chroma of each pixel, and a red chroma total value buffer that stores the accumulated value as a red chroma total value; and an average calculation section that calculates a luminance average value, a blue chroma average value, and a red chroma average value based on the luminance total value, the blue chroma total value, and the red chroma total value that have been calculated.

2. The image display control device as defined in claim 1, a count operation of the statistical value buffer included in each of the plurality of statistical units and a count operation of each of the luminance total value buffer, the blue chroma total value buffer, and the red chroma total value buffer being suspended when it is unnecessary to acquire the statistical information.

3. A driver device of an electro-optical device, the driver device including the image display control device as defined in claim 1.

4. A control device of an electro-optical device, the control device including the image display control device as defined in claim 1.

5. A drive control device of an electro-optical device, the drive control device including the image display control device as defined in claim 1.

6. An electronic instrument including the image display control device as defined in claim 1.

* * * * *